US009494123B2

(12) United States Patent
Kawazu et al.

(10) Patent No.: US 9,494,123 B2
(45) Date of Patent: Nov. 15, 2016

(54) SYSTEM FOR CRANKING INTERNAL COMBUSTION ENGINE BY ENGAGEMENT OF PINION WITH RING GEAR

(75) Inventors: Shinsuke Kawazu, Toyokawa (JP); Hideya Notani, Kariya (JP); Akira Kato, Kani (JP)

(73) Assignee: DENSO CORPORATION, Kariya (JP)

( * ) Notice: Subject to any disclaimer, the term of this patent is extended or adjusted under 35 U.S.C. 154(b) by 1135 days.

(21) Appl. No.: 12/962,840

(22) Filed: Dec. 8, 2010

(65) Prior Publication Data

US 2011/0137544 A1 Jun. 9, 2011

(30) Foreign Application Priority Data

| | | |
|---|---|---|
| Dec. 8, 2009 | (JP) | 2009-278455 |
| Dec. 11, 2009 | (JP) | 2009-281443 |
| Aug. 26, 2010 | (JP) | 2010-189970 |
| Oct. 5, 2010 | (JP) | 2010-225380 |

(51) Int. Cl.
*F02N 11/08* (2006.01)
*F02N 15/06* (2006.01)

(52) U.S. Cl.
CPC ..... *F02N 11/0855* (2013.01); *F02N 15/06* (2013.01); *F02N 11/0814* (2013.01); *F02N 11/0844* (2013.01); *F02N 2200/022* (2013.01); *F02N 2200/041* (2013.01); *F02N 2200/048* (2013.01); *F02N 2300/2006* (2013.01)

(58) Field of Classification Search
CPC ..... F02N 11/0855; F02N 11/0844; F02N 2200/022; F02N 15/067; F02N 2200/048; F02N 11/0814; Y02T 10/48
USPC ..... 123/179.25, 179.3, 179.4; 290/38 C, 290/38 E, 38 R; 701/112, 113
See application file for complete search history.

(56) References Cited

U.S. PATENT DOCUMENTS

| | | | |
|---|---|---|---|
| 6,760,681 | B2 | 7/2004 | Takahashi et al. |
| 7,027,911 | B2 | 4/2006 | Nishikawa et al. |
| 7,177,755 | B2 | 2/2007 | Nishikawa et al. |

(Continued)

FOREIGN PATENT DOCUMENTS

| | | |
|---|---|---|
| EP | 2 159 410 | 3/2010 |
| JP | 2002-070699 | 3/2002 |

(Continued)

OTHER PUBLICATIONS

Office Action (2 pages) dated Oct. 1, 2013, issued in corresponding Japanese Application No. 2010-189970 and English translation (3 pages).
Chinese Office Action dated May 22, 2012, issued in corresponding Chinese Application No. 201010625113.2 with English Translation.
Japanese Office Action dated Dec. 1, 2011, issued in corresponding Japanese Application No. 2010225380 with English Translation.

*Primary Examiner* — Sizo Vilakazi
(74) *Attorney, Agent, or Firm* — Nixon & Vanderhye PC

(57) ABSTRACT

In a system for driving a starter with a pinion so that the starter rotates a ring gear coupled to a crankshaft of an internal combustion engine to crank the internal combustion engine during a drop of a rotational speed of the crankshaft by automatic-stop control of the internal combustion engine, a predictor predicts a future trajectory of the drop of the rotational speed of the crankshaft based on information associated with the drop of the rotational speed of the crankshaft. A determiner determines a timing of the driving of the starter based on the future trajectory of the drop of the rotational speed of the internal combustion engine.

12 Claims, 21 Drawing Sheets

(56) References Cited

U.S. PATENT DOCUMENTS

| | | | | |
|---|---|---|---|---|
| 7,269,499 | B2 | 9/2007 | Murakami et al. | |
| 7,275,509 | B2 * | 10/2007 | Kassner | F02N 11/0844 123/179.25 |
| 8,036,815 | B2 | 10/2011 | Okumoto et al. | |
| 8,069,832 | B2 | 12/2011 | Okumoto et al. | |
| 8,196,558 | B2 | 6/2012 | Okumoto et al. | |
| 8,370,051 | B2 * | 2/2013 | Pursifull | F02D 41/042 123/179.4 |
| 8,671,903 | B2 * | 3/2014 | Notani | F02N 11/0855 123/179.4 |
| 2003/0149541 | A1 | 8/2003 | Takahashi et al. | |
| 2004/0149251 | A1 | 8/2004 | Nishikawa et al. | |
| 2005/0228575 | A1 | 10/2005 | Murakami et al. | |
| 2006/0129305 | A1 | 6/2006 | Nishikawa et al. | |
| 2007/0137602 | A1 | 6/2007 | Kassner | |
| 2010/0050970 | A1 | 3/2010 | Okumoto et al. | |
| 2010/0326389 | A1 | 12/2010 | Okumoto et al. | |
| 2011/0270512 | A1 * | 11/2011 | Hayashi | F02N 11/0844 701/112 |
| 2012/0029797 | A1 * | 2/2012 | Notani | F02N 11/0844 701/113 |
| 2012/0035837 | A1 | 2/2012 | Okumoto et al. | |

FOREIGN PATENT DOCUMENTS

| | | | | |
|---|---|---|---|---|
| JP | 2002-257841 | | 9/2002 | |
| JP | 2004-245106 | | 9/2004 | |
| JP | P2005-299445 | A | 10/2005 | |
| JP | 2005-330813 | | 12/2005 | |
| JP | 2005330813 | A * | 12/2005 | F02N 15/06 |
| JP | 2007-107527 | | 4/2007 | |

* cited by examiner

FIG.3

| | °CA | rod/s | LOSS-TORQUE CALCULATION | ENGINE-SPEED PREDICTION | | ARRIVAL-TIME PREDICTION |
|---|---|---|---|---|---|---|
| | | | | REGISTER RE | | |
| i-1 | 0 | $\omega[0,i-1]$ | | | | |
| | 30 | $\omega[30,i-1]$ | $T[0-30,i-1]=-J(\omega^2[30,i-1]-\omega^2[0,i-1])/2$ | 0 → 30 | $T_{[0-30,i-1]}$ | |
| | 60 | $\omega[60,i-1]$ | $T[30-60,i-1]=-J(\omega^2[60,i-1]-\omega^2[30,i-1])/2$ | 30 → 60 | $T_{[30-60,i-1]}$ | |
| | 90 | $\omega[90,i-1]$ | $T[60-90,i-1]=-J(\omega^2[90,i-1]-\omega^2[60,i-1])/2$ | 60 → 90 | $T_{[60-90,i-1]}$ | |
| | 120 | $\omega[120,i-1]$ | $T[90-120,i-1]=-J(\omega^2[120,i-1]-\omega^2[90,i-1])/2$ | 90 → 120 | $T_{[90-120,i-1]}$ | |
| | 150 | $\omega[150,i-1]$ | $T[120-150,i-1]=-J(\omega^2[150,i-1]-\omega^2[120,i-1])/2$ | 120 → 150 | $T_{[120-150,i-1]}$ | |
| CURRENT TIME i | 0 | $\omega[0,i]$ | $T[150-0,i-1]=-J(\omega^2[0,1]-\omega^2[150,i-1])/2$ | 150 → 0 | $T_{[150-0,i-1]}$ | |
| | 30 | $\omega[30,i]$ | $T[0-30,i]=-J(\omega^2[30,i]-\omega^2[0,i])/2$ | $\omega'^2[60,i]=\omega^2[30,i]-\frac{2}{J}T_{[30-60,i-1]}$ | | $t_{[90-60,i]}=\frac{\pi}{6\cdot\omega'_{[60,i]}}$ |
| | 60 | $\omega[60,i]$ | | $\omega'^2[90,i]=\omega'^2[60,i]-\frac{2}{J}T_{[60-90,i-1]}$ $=\omega^2[30,i]-\frac{2}{J}(T_{[30-60,i-1]}+T_{[60-90,i-1]})$ | | $t_{[60-90,i]}=\frac{\pi}{6\cdot\omega'_{[90,i]}}$ |
| | 90 | $\omega[90,i]$ | PREDICT FUTURE ANGULAR VELOCITIES AND FUTURE ARRIVAL TIMES | $\omega'^2[120,i]=\omega'^2[90,i]-\frac{2}{J}T_{[90-120,i-1]}$ $=\omega^2[30,i]-\frac{2}{J}(T_{[30-60,i-1]}+T_{[60-90,i-1]}+T_{[90-120,i-1]})$ | | |
| | 120 | $\omega[120,i]$ | | • | | • |
| | 150 | $\omega[150,i]$ | | • | | • |
| i+1 | 0 | $\omega[0,i+1]$ | | | | |
| | 30 | $\omega[30,i+1]$ | | $\omega'^2[30,i+1]=\omega^2[30,i]-\frac{2}{J}(T_{[30-60,i-1]}+T_{[60-90,i-1]}+T_{[90-120,i-1]}\cdots+T_{[0-30,i]})$ | | $t_{[0-30,i+1]}=\frac{\pi}{6\cdot\omega'_{[30,i+1]}}$ |
| | 60 | $\omega[60,i+1]$ | | • | | • |

SYSTEM FOR CRANKING INTERNAL COMBUSTION ENGINE BY ENGAGEMENT OF PINION WITH RING GEAR

CROSS REFERENCE TO RELATED APPLICATIONS

This application is based on Japanese Patent Applications 2009-281443, 2009-278455, 2010-189970, and 2010-225380 filed on Dec. 11, 2009, Dec. 8, 2009, Aug. 26, 2010, and Oct. 5, 2010, respectively. This application claims the benefit of priority from the Japanese Patent Applications, so that the descriptions of which are all incorporated herein by reference.

TECHNICAL FIELD

The present disclosure relate to systems for shifting, during a rotational speed of a crankshaft of an internal combustion engine dropping based on automatic stop control of the internal combustion engine, a pinion of a starter to a ring gear coupled to the crankshaft of the internal combustion engine so as to engage the pinion with the ring gear.

BACKGROUND

Japanese Patent Application Publication No. 2005-330813 discloses an engine stop-and-start system, such as an idle reduction control system, as one type of these systems.

Specifically, the engine stop-and-start system is designed to start energization of a motor of a starter to rotate a pinion of the starter at the timing when an engine restart request occurs during a rotational speed of a crankshaft of an internal combustion engine, referred to simply as an engine, dropping based on automatic stop control of the engine.

The engine stop-and-start system is designed to predict the timing when the rotational speed of the crankshaft (ring gear) will be synchronized with the rotational speed of the pinion in consideration of a time required for the pinion to reach a position engageable with the ring gear. The engine stop-and-start system is also designed to determine the timing to start shifting of the pinion to the ring gear based on the predicted timing when the rotational speed of the ring gear will be synchronized with the rotational speed of the pinion.

SUMMARY

The inventors have discovered that there are points that should be improved in the engine stop-and-start system set forth above.

Specifically, the rotational speed of the crankshaft of the engine does not drop linearly but drops with fluctuation, so that the rotational speed of the ring gear drops with fluctuation, too. This fluctuation may deteriorate, even if the engine stop-and-start system predicts the timing when the rotational speed of the crankshaft (ring gear) will be synchronized with the rotational speed of the pinion, the accuracy of the prediction. This may result in an increase in the difference between the rotational speed of the pinion and that of the ring gear at the engagement of the pinion with the ring gear. The increase in the rotational-speed difference between the pinion and the ring gear, in other words, the relative rotational speed therebetween, may result in an increase in the level of noise at the engagement of the pinion with the ring gear (see FIG. 7 described later).

In view of the circumstances set forth above, one of various aspects of the present invention seeks to provide systems for cranking an internal combustion engine; this one of various aspects of the present invention is designed to improve at least one of the points set forth above.

Specifically, an alternative of the various aspects of the present invention aims at providing systems for cranking an internal combustion engine; this alternative of the various aspects of the present invention is designed to determine, with high accuracy, the timing to drive a starter for restart of the internal combustion engine.

According to one aspect of the present invention, there is provided a system for driving a starter with a pinion so that the starter rotates a ring gear coupled to a crankshaft of an internal combustion engine to crank the internal combustion engine during a drop of a rotational speed of the crankshaft by automatic-stop control of the internal combustion engine. The system includes a predictor that predicts a future trajectory of the drop of the rotational speed of the crankshaft based on information associated with the drop of the rotational speed of the crankshaft, and a determiner that determines a timing of the driving of the starter based on the future trajectory of the drop of the rotational speed of the internal combustion engine.

The one aspect of the present invention predicts the future trajectory of the drop of the rotational speed of the crankshaft with fluctuation after automatic stop control of the internal combustion engine. Thus, even if the rotational speed of the crankshaft fluctuates while dropping, the one aspect of the present invention can predict, with high accuracy, the timing to drive the starter to shift the pinion to the ring gear for engagement of the pinion with the ring gear based on the future trajectory of the drop of the rotational speed of the crankshaft.

The one aspect of the present invention can be applied to a usual starter designed to simultaneously drive a pinion actuator and a motor or drive one of the pinion actuator and the motor, and after the lapse of a preset delay time, drive the other thereof. When the one aspect of the present invention is applied to such a usual starter, the determiner can determine the timing of the driving of the starter based on the future trajectory of the drop of the rotational speed of the internal combustion engine when the rotational speed of the crankshaft is within a very low-speed range. While the rotational speed of the crankshaft remains within the very low-speed range, the noise level at the engagement between the pinion and the ring gear can be maintained within an allowable range.

The one aspect of the present invention can be applied to a starter with a pinion actuator for shifting the pinion to the ring gear and a motor for rotating the pinion independently of the pinion actuator. In this application, the determiner is configured to determine, as the timing of the driving of the starter, a first timing to drive the pinion actuator to shift the pinion to the ring gear and a second timing to drive the motor to rotate the pinion based on the future trajectory of the drop of the rotational speed of the internal combustion engine. For example, when an engine restart condition is met within a relatively high RPM range of the rotational speed of the crankshaft, the determiner can determine the second timing earlier than the first timing. For example, when an engine restart condition is met within a relatively low RPM range of the rotational speed of the crankshaft, the determiner can determine the first timing earlier than the second timing.

According to an alternative aspect of the present invention, there is provided a system for driving a starter with a pinion to thereby shift the pinion to a ring gear coupled to a crankshaft of an internal combustion engine for restart thereof during a drop of a rotational speed of the crankshaft by automatic—stop control of the internal combustion engine. The internal combustion engine works to reciprocate a piston in a cylinder through a top dead center (TDC) of the cylinder to thereby rotate the crankshaft. The system includes a last TDC determiner that determines, based on information associated with the drop of the rotational speed of the crankshaft, a timing at which the piston reaches a last TDC in forward rotation of the crankshaft during the drop of the rotational speed of the crankshaft. The system includes a driving timing determiner that determines a timing of the driving of the starter based on the timing of the last TDC in the forward rotation of the crankshaft during the drop of the rotational speed of the crankshaft.

The alternative aspect of the present invention can determine the last TDC in the forward rotation of the crankshaft during the drop of the rotational speed of the crankshaft, making it possible to determine the timing of driving the pinion for restart of the internal combustion engine relative to the last TDC timing.

The above and/or other features, and/or advantages of various aspects of the present invention will be further appreciated in view of the following description in conjunction with the accompanying drawings. Various aspects of the present invention can include and/or exclude different features, and/or advantages where applicable. In addition, various aspects of the present invention can combine one or more feature of other embodiments where applicable. The descriptions of features, and/or advantages of particular embodiments should not be constructed as limiting other embodiments or the claims.

BRIEF DESCRIPTION OF THE DRAWINGS

Other objects and aspects of the invention will become apparent from the following description of embodiments with reference to the accompanying drawings in which:

FIG. 3 is a table schematically illustrating examples of methods to calculate values kiss torque of an internal combustion engine illustrated in FIG. 1, to predict values of an angular velocity of the crankshaft of the internal combustion engine, and to predict values of arrival time of the crankshaft according to the first embodiment;

DETAILED DESCRIPTION OF EMBODIMENTS OF THE INVENTION

Figure 1:
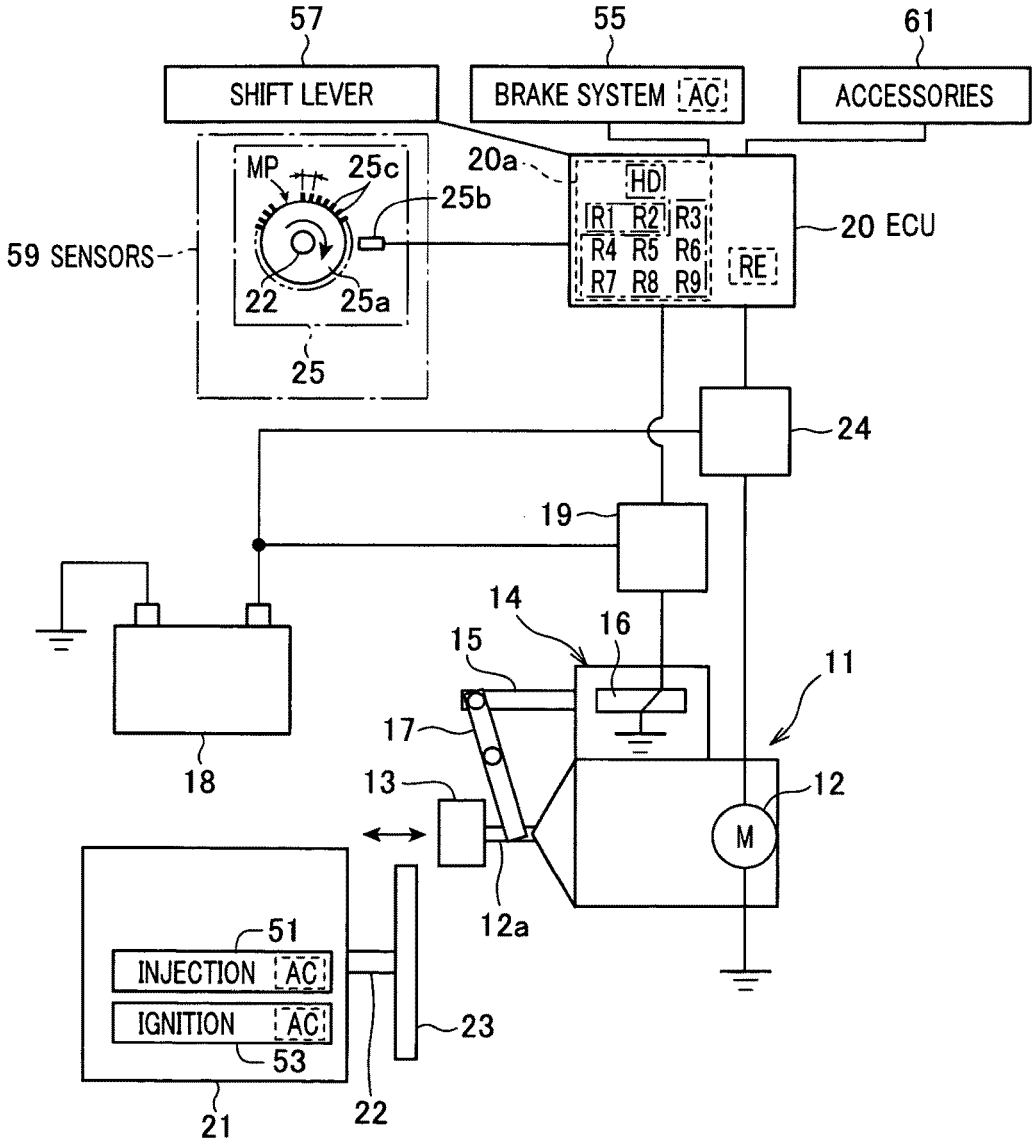
FIG. 1 is a view schematically illustrating an example of the overall hardware structure of an engine control system according to the first embodiment of the present invention.

Embodiments of the present invention will, be described hereinafter with reference to the accompanying drawings.

In the embodiments, like parts between the embodiments, to which like reference characters are assigned, are omitted or simplified in redundant description.

First Embodiment

In the first embodiment, the present invention is applied to an engine starting system designed as a part of an engine control system 1 installed in a motor vehicle. The engine control system 1 is comprised of an electronic control unit (ECU) 20 as a central device thereof, and is operative to control the quantity of fuel to be sprayed and the timing of ignition, and carry out a task of automatically stopping an internal combustion engine (referred to simply as engine) 21 and a task of restarting the engine 21. An example of the overall structure of the engine control system 1 is illustrated in FIG. 1. As the engine 21, a four-stroke, four-cylinder engine is employed in the first embodiment as an example.

Referring to FIG. 1, the engine 21 has a crankshaft 22, as an output shaft thereof, with one end to which a ring gear 23 is directly or indirectly coupled. The crankshaft 22 is coupled to the piston via a connection rod within each cylinder such that travel of the piston in each cylinder up and down allows the crankshaft 22 to be turned.

Specifically, the engine 21 works to compress air-fuel mixture or air by the piston within each cylinder and burn the compressed air-fuel mixture or the mixture of the compressed air and fuel within each cylinder. This changes the fuel energy to mechanical energy, such as rotative energy, to reciprocate the piston between a top dead center (TDC) to a bottom dead center (BDC) of each cylinder within each cylinder, thus rotating the crankshaft 22. The rotation of the crankshaft 22 is transferred to driving wheels through a powertrain installed in the motor vehicle to thereby drive the motor vehicle. Oil (engine oil) is within each cylinder to lubricate any two parts placed in the engine 21 to be in contact with each other, such as the moving piston and each cylinder.

The engine 21 is installed with, for example, a fuel injection system 51 and an ignition system 53.

The fuel injection system 51 includes actuators, such as fuel injectors, AC and causes the actuators AC to spray fuel either directly into each cylinder of the engine 21 or into an intake manifold (or intake port) just ahead of each cylinder thereof to thereby burn the air-fuel mixture in each cylinder of the engine 21.

The ignition system 53 includes actuators, such as igniters, AC and causes the actuators AC to provide an electric current or spark to ignite an air-fuel mixture in each cylinder of the engine 21, thus burning the air-fuel mixture.

When the engine 21 is designed as a diesel engine, the ignition system 53 can be eliminated.

In addition, in the motor vehicle, for slowing down or stopping the motor vehicle, a brake system 55 is installed.

The brake system 55 includes, for example, disc or drum brakes as actuators AC at each wheel of the motor vehicle. The brake system 55 is operative to send, to each of the brakes, a deceleration signal indicative of a braking force to be applied from each brake to a corresponding one of the wheels in response to a brake pedal of the motor vehicle being depressed by the driver. This causes each brake to slow down or stop the rotation of a corresponding one of the wheels of the motor vehicle based on the sent deceleration signal.

Reference numeral 57 represents a hand-operable shift lever (select lever). When the motor vehicle is a manual transmission vehicle, the driver can change a position of the shift lever 57 to shift (change) a transmission gear ratio of the powertrain to thereby control the number of revolutions of the driving wheels and the torque generated by the engine 21 to the driving wheels. When the motor vehicle is an automatic transmission vehicle, the driver can change a position of the shift lever 57 to select one of the drive ranges corresponding to a transmission gear ratio of the powertrain, such as Reverse range, Neutral range, Drive range, and the like.

Referring to FIG. 1, the engine control system 1 includes a starter 11, a chargeable battery 18, a relay 19, and a switching element 24.

The starter 11 is comprised of a starter motor (motor) 12, a pinion 13, and a pinion actuator 14.

The motor 12 is made up of an output shaft 12*a* and an armature coupled to the output shaft 12*a* and operative to rotate the output shaft 12*a* when the armature is energized.

The pinion 13 is mounted on the outer surface of one end of the output shaft 12*a* to be shiftable in an axial direction of the output shaft 12*a*.

The motor 12 is arranged opposing the engine 21 such that the shift of the pinion 13 in the axial direction of the output shaft 12*a*, toward the engine 21 allows the pinion 13 to abut on the ring gear 23 of the engine 21.

The pinion actuator, referred to simply as an "actuator", 14 is made up of a plunger 15, a solenoid 16, and a shift lever 17. The plunger 15 is so arranged in parallel to the axial direction of the output shaft 12*a* of the motor 12 as to be shiftable in its length direction parallel to the axial direction of the output shaft 12*a*.

The solenoid 16 is, for example, arranged to surround the plunger 15. One end of the solenoid 16 is electrically connected to a positive terminal of the battery 18 via the relay 19, and the other end thereof is grounded. The shift lever 17 has one end and the other end in its length direction. The one end of the shift lever 17 is pivotally coupled to one end of the plunger 15, and the other end thereof is coupled to the output shaft 12*a*. The shift lever 17 is pivoted about a pivot located at its substantially middle in the length direction.

The solenoid 16 works to shift the plunger 15 thereinto in the length direction of the plunger 15 so as to pull the plunger 15 thereinto against the force of return spring (not shown) when energized. The pull-in shift of the plunger 15 pivots the shift lever 17 clockwise in FIG. 1 whereby the pinion 13 is shifted to the ring gear 23 of the engine 21 via the shift lever 17. This allows the pinion 13 to be meshed with the ring gear 23 for cranking the engine 21. When the solenoid 16 is deenergized, the return spring returns the plunger 15 and the shift lever 17 to their original positions illustrated in FIG. 1 so that the pinion 13 is pulled-out of mesh with the ring gear 23.

The relay 19 is designed as a mechanical relay or a semiconductor relay. The relay 19 has first and second terminals (contacts) electrically connected to the positive terminal of the battery 18 and the one end of the solenoid 16, respectively, and a control terminal electrically connected to the ECU 20.

For example, when an electric signal indicative of switch-on of the relay 19 is sent from the ECU 20, the relay 19 establishes electric conduction between the first and second terminals of the relay 19 to switch on the relay 19. This allows the battery 18 to supply a DC (Direct Current) battery voltage to the solenoid 16 via the relay 19 to thereby energize the solenoid 16.

When energized, the solenoid 16 pulls the plunger 15 thereinto against the force of the return spring. The pull of the plunger 15 into the solenoid 16 causes the pinion 13 to be shifted to the ring gear 23 via the shift lever 17. This allows the pinion 13 to be meshed with the ring gear 23 for cranking the engine 21.

Otherwise, when no electric signals are sent from the ECU 20 to the relay 19, the relay 19 is off, resulting in that the solenoid 16 is deenergized.

When the solenoid 16 is deenergized, the return spring of the actuator 14 returns the plunger 15 to its original position illustrated in FIG. 1 so that the pinion 13 is out of mesh with the ring gear 23 in its initial state.

The switching element 24 has first and second terminals electrically connected to the positive terminal of the battery 18 and the armature of the motor 12, respectively, and a control terminal electrically connected to the ECU 20.

For example, when an electric signal, such as a pulse current with a pulse width (pulse duration) corresponding to the energization duration (on period) of the switching element 24, is sent from the ECU 20 to the switching element 24, the switching element 24 establishes, during on period of the pulse current, electric conduction between the first and second terminals to thereby turn on the switching element 24. This allows the battery 18 to supply the battery voltage to the armature of the motor 12 to energize it.

The switching element 24 also interrupts, during off period of the pulse current, the electric conduction between the first and second terminals to thereby establish electrical disconnection between the battery 18 and the armature of the motor 12. When no pulse current is sent from the ECU 20 to the switching element 24, the switching element 24 is off so that the motor 12 is inactivated. A duty cycle of the motor 12 is represented as a ratio of the on period (pulse width) of the pulse current to the repetition interval (sum of the on and off periods) thereof. That is, the ECU 20 is adapted to adjust the on period (pulse width) of the pulse current to adjust the duty cycle of the motor 12 to thereby control the rotational speed of the motor 12, that is, the rotational speed of the pinion 13.

In addition, the engine control system 1 includes sensors 59 for measuring the operating conditions of the engine 21 and the driving conditions of the motor vehicle.

Each of the sensors 59 is operative to measure an instant value of a corresponding one parameter associated with the operating conditions of the engine 21 and/or the motor vehicle and to output, to the ECU 20, a signal indicative of the measured value of a corresponding one parameter.

Specifically, the sensors 59 include, for example, a crank angle sensor (crankshaft sensor) 25, an accelerator sensor (throttle position sensor), and a brake sensor; these sensors are electrically connected to the ECU 20.

The crank angle sensor 25 is operative to output, to the ECU 20, a crank pulse each time the crankshaft 22 is rotated by a preset angle. An example of the specific structure of the crank angle sensor 25 will be described later.

The cam angle sensor is operative to measure the rotational position of a camshaft (not shown) as an output shaft of the engine 21, and output, to the ECU 20, a signal indicative of the measured rotational position of the camshaft. The camshaft is driven by gears, a belt, or a chain from the crankshaft 22, and is designed to turn at half the speed of the crankshaft 22. The camshaft is operative to cause various valves in the engine 21 to open and close.

The accelerator sensor is operative to:

measure an actual position or stroke of a driver-operable accelerator pedal of the motor vehicle linked to a throttle valve for controlling the amount of air entering the intake manifold; and output a signal indicative of the measured actual stroke or position of the accelerator pedal to the ECU 20.

The brake sensor is operative to measure an actual position or stroke of the brake pedal of the vehicle operable by the driver and to output a signal indicative of the measured actual stroke or position of the brake pedal.

As the crank angle sensor 25, a normal magnetic-pickup type angular sensor is used in this embodiment. Specifically, the crank angle sensor 25 includes a rector disk (pulses) 25*a* coupled to the crankshaft 22 to be integrally rotated therewith. The crank angle sensor 25 also includes an electromagnetic pickup (referred to simply as "pickup") 25*b* arranged in proximity to the reluctor disk 25*a*.

The reluctor disk 25*a* has teeth 25*c*, spaced at preset crank-angle intervals, for example, 30° intervals ($\pi/6$ radian intervals), around the outer circumferential surface thereof. The rectangular disk 25*a* also has, for example, one tooth missing portion MP at which a preset number of teeth, such as one tooth or several teeth, are missed. The preset crank-angle intervals define a crank-angle measurement resolution of the crank angle sensor 25. For example, when the teeth 25*c* are spaced at 30-degree intervals, the crank-angle measurement resolution is set to 30 degrees.

The pickup 25*b* is designed to pick up a change in a previously formed magnetic field according to the rotation of the teeth 25*c* of the reluctor disk 25*a* to thereby generate a crank pulse, which is a transition of a base signal level to a preset signal level.

Specifically, the pickup 25*b* is operative to output a crank pulse every time one tooth 25*c* of the rotating reluctor disk 25*a* passes in front of the pickup 25*b*.

The train of crank pulses outputted from the pickup 25*b*, which is referred to as a "crank signal", is sent to the ECU 20; this crank signal is used by the ECU 20 to calculate the rotational speed of the engine 21 and/or an angular velocity $\omega$ of the crankshaft 22 (engine 21).

The ECU 20 is designed as, for example, a normal microcomputer circuit consisting of, for example, a CPU, a storage medium 20*a* including a ROM (Read Only Memory), such as a rewritable ROM, a RAM (Random Access Memory), and the like, an IO (Input and output) interface, and so on. The normal microcomputer circuit is defined in the first embodiment to include at least a CPU and a main memory therefor.

The storage medium 20*a* stores therein beforehand various engine control programs.

The ECU 20 is operative to:

receive the signals outputted from the sensors 59; and control, based on the operating conditions of the engine 21 determined by at least some of the received signals from the sensors 59, various actuators AC installed in the engine 21 to thereby adjust various controlled variables of the engine 21.

The ECU 20 is operative to determine, based on the crank signal outputted from the crank angle sensor 25, a rotational position (crank angle) of the crankshaft 22 relative to a reference position and the rotational speed NE of the engine 21, and determine various operating timings of the actuators AC based on the crank angle of the crankshaft 22 relative to the reference position. The reference position can be determined based on the location of the tooth missing portion MP and/or on the signal outputted form the camshaft sensor.

Specifically, the ECU 20 is programmed to:

adjust a quantity of intake air into each cylinder;

compute a proper fuel injection timing and a proper injection quantity for the fuel injector AC for each cylinder and a proper ignition timing for the igniter AC for each cylinder;

instruct the fuel injector AC for each cylinder to spray, at a corresponding computed proper injection timing, a corresponding computed proper quantity of fuel into each cylinder; and instruct the igniter AC for each cylinder to ignite the compressed air-fuel mixture or the mixture of the compressed air and fuel in each cylinder at a corresponding computed proper ignition timing.

In addition, the engine control programs stored in the storage medium 20*a* include an engine stop-and-start control routine (program). For example, the ECU 20 repeatedly runs the engine stop-and-start control routine while the ECU 20 runs a main engine control routine; the main engine control routine is continuously run by the ECU 20 during the ECU 20 being ON.

Specifically, in accordance with the engine stop-and-start control routine, the ECU 20 repetitively determines whether at least one of predetermined engine automatic stop conditions is met, in other words, whether an engine automatic stop request (idle reduction request) occurs based on the signals outputted from the sensors 59.

Upon determining that no predetermined engine automatic stop conditions are met, the ECU 20 exits the engine stop-and-start control routine.

Otherwise, upon determining that at least one of the predetermined engine automatic stop conditions is met, that is, an automatic stop request occurs, the ECU 20 carries out an engine stop-and-start task. Specifically, the ECU 20 controls the fuel injection system 51 to stop the supply of fuel (cut fuel) into each cylinder, and/or controls the ignition system 53 to stop the ignition of the air-fuel mixture in each cylinder, thus stopping the burning of the air-fuel mixture in each cylinder. The stop of the burning of the air-fuel mixture in each cylinder of the engine 21 means the automatic stop of the engine 21. For example, the ECU 20 according to the first embodiment cuts fuel into each cylinder to thereby automatically stop the engine 21.

The predetermined engine automatic stop conditions include, for example, the following conditions that:

the engine speed is equal to or lower than a preset speed (idle-reduction execution speed) when either the stroke of the driver's accelerator pedal is zero (the driver completely releases the accelerator pedal) so that the throttle valve is positioned in its idle speed position or the driver depresses the brake pedal; and the motor vehicle is stopped during the brake pedal being depressed.

After the automatic stop of the engine 21, during the rotational speed of the engine 21 dropping, in other words, the crankshaft 22 coasting, the ECU 20 carries out a pinion pre-rotation subroutine to thereby rotate the pinion 13 in response to when determining that at least one of predetermined engine restart conditions is met, that is an engine restart request occurs, based on the signals outputted from the sensors 59. The predetermined engine restart conditions include, for example, the following conditions that:

at least one operation for the start of the motor vehicle is operated by the driver; and the accelerator pedal is depressed (the throttle valve is opened) to start the motor vehicle.

As the at least one operation for the start of the motor vehicle, the driver completely releases the brake pedal or changes the position of the shift lever 57 to the Drive range (when the motor vehicle is an automatic vehicle).

In addition, when an engine restart request is inputted to the ECU 20 from at least one of accessories 61 installed in the motor vehicle, the ECU 20 determines that a corresponding one of the engine restart conditions is met. The accessories 61 include, for example, a battery-charge control system for controlling the SOC (State Of Charge) of the battery 18 or another battery and an air conditioner for controlling the temperature and/or humidity within the cab of the motor vehicle.

After the pre-rotation of the pinion 13, when determining that the difference between the rotational speed of the pinion 13 and that of the ring gear 23 is small, the ECU 20 shifts the pre-rotating pinion 13 to the ring gear 23 so that the pre-rotating pinion 13 is smoothly engaged with the ring gear 23, thus cranking the engine 21. This results in that the crankshaft 22 is turned at an initial speed (idle speed).

Thus, the ECU 20 instructs the injector AC for each cylinder to restart spraying fuel into a corresponding cylinder, and instructs the igniter AC for each cylinder to restart igniting the air-fuel mixture in a corresponding cylinder.

Note that, after the automatic stop of the engine 21, during the rotational speed of the engine 21 dropping, in other words, the crankshaft 22 coasting, the ECU 20 can carry out a pinion-preset subroutine to thereby shift the pinion 13 to the ring gear 23 before an engine restart request occurs so that the pinion 13 is engaged with the ring gear 23 for the occurrence of an engine restart request, and maintain the pinion 13 meshed with the ring gear 23. Note that the ECU 20 can carry out the pinion-preset subroutine when at least one of the engine automatic stop conditions is met. That is, the ECU 20 can carry out the pinion-preset subroutine in parallel to executing the engine automatic stop control.

Thereafter, the ECU 20 determines whether at least one of the predetermined engine restart conditions is met, that is an engine restart request occurs, based on the signals outputted from the sensors 59.

When determining that at least one of the predetermined engine restart conditions is met based on the signals outputted from the sensors 59, the ECU 20 carries out an engine restart task. The engine restart task is to:

energize the motor 12 of the starter 11 to rotate the pinion 13 to thereby crank the engine 21 so that the crankshaft 22 is turned up to a preset initial speed (idle speed) under control of the duty cycle of the motor 12 (in the case of the pinion-preset subroutine);

instruct the injector AC for each cylinder to restart spraying fuel into a corresponding cylinder; and instruct the igniter AC for each cylinder to restart igniting the air-fuel mixture in a corresponding cylinder.

During execution of the engine stop-and-start control routine, the

ECU 20 monitors the rotational speed of the crankshaft 22 of the engine 21; this rotational speed of the crankshaft 22 of the engine 21 will also referred to simply as an engine speed.

After the engine restart task, when the engine speed exceeds a preset threshold for determination of whether the start of the motor vehicle is completed. When the engine speed exceeds the preset threshold, the ECU 20 determines that the start of the motor vehicle is completed, thus deenergizing the motor 12 of the starter 11 via the switching element 24 and deenergizing the pinion actuator 14 via the relay 19. This allows the return spring returns the plunger 15 and the shift lever 17 to their original positions illustrated in FIG. 1 so that the pinion 13 is pulled-out of mesh with the ring gear 23 to be returned to its original position illustrated in FIG. 1.

Figure 5A:
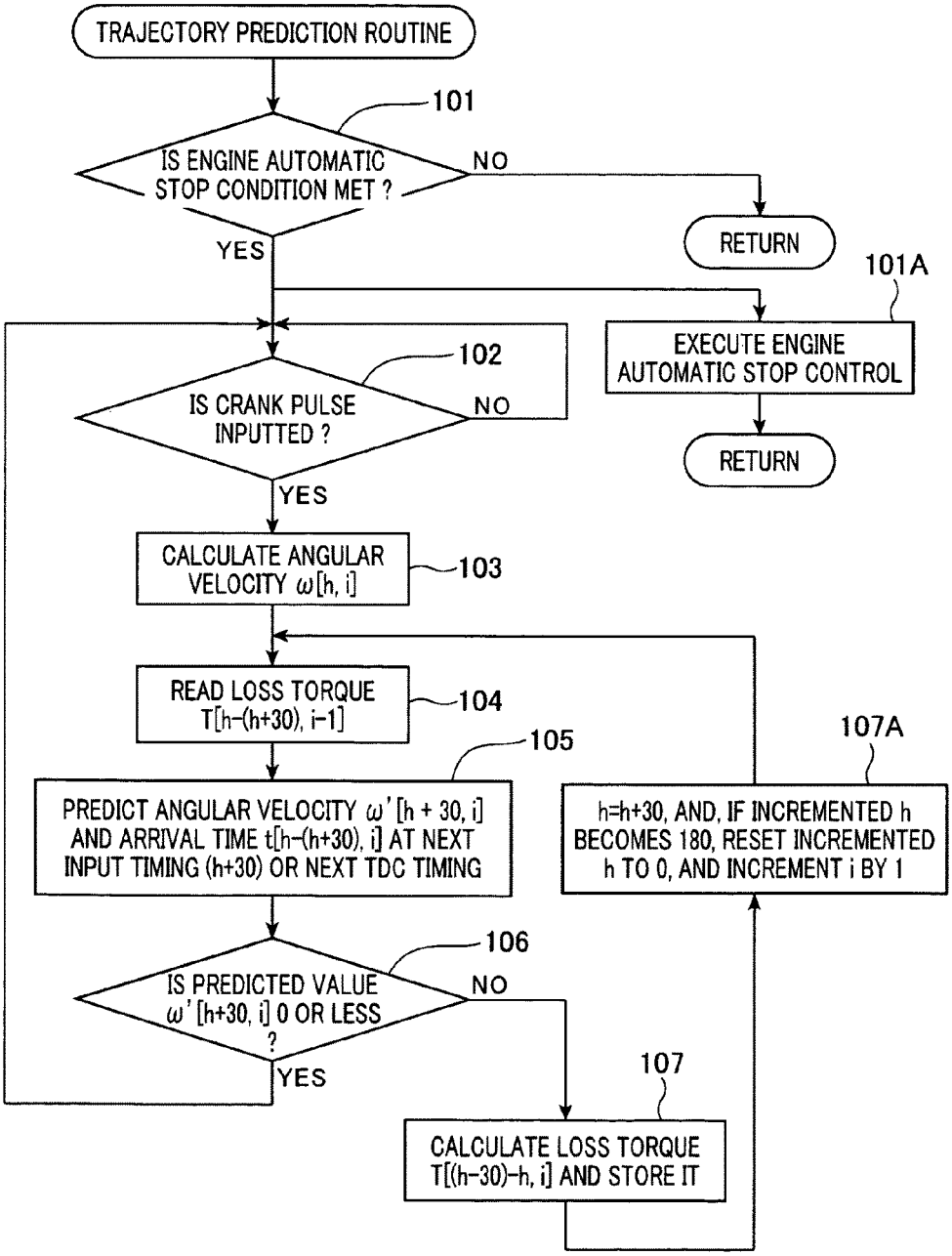
FIG. 5A is a flowchart schematically illustrating a trajectory prediction routine to be executed by an ECU illustrated in FIG. 1 according to the first embodiment.

Particularly, the ECU 20 is designed to carry out a trajectory prediction routine R1 in accordance with the flowchart illustrated in FIG. 5A as part of the engine stop-and-start control routine to thereby function as means for predicting the future trajectory of the drop of the engine speed. The ECU 20 is also designed to carry out a starter control routine R2 in accordance with the flowchart illustrated in FIG. 6 as part of the engine stop-and-start control routine to thereby function as means for determining the timing to drive the pinion 13 for restart of the engine 21 based on predict data of the future trajectory of the drop of the engine speed achieved by the trajectory prediction routine.

Next, how to predict the future trajectory of the drop of the engine speed according to the first embodiment will be described hereinafter using, as the crank angle sensor 25, a crank angle sensor designed to output, to the ECU 20, a crank pulse every time the crankshaft 22 is rotated by 30 degrees (30 crank angle degrees).

The ECU 20 computes (calculates) an angular velocity ω of the crankshaft 22 (engine 21) in accordance with the following equation (1) every time one crank pulse of the crank signal is currently inputted to the ECU 20 during the engine speed dropping:

$$\omega[\text{rad/sec}] = \frac{30 \times 2\pi}{360 \times tp} \tag{1}$$

where tp represents the pulse interval [sec] in the crank signal.

Because the engine 21 is a four-stroke, four-cylinder engine, the engine 21 has a cylinder on a power stroke every 180 degrees of the rotation of the crankshaft 22. For example, the crank angle of the crankshaft 22 is 0 degrees (0 crank angle degrees) relative to the reference position each time the piston in a cylinder is located at the TDC.

Note that "i" is a parameter indicative of a present period of 180 crank-angle degrees (CAD) of the rotation of the crankshaft 22.

Specifically, the ECU 20 computes a value of the angular velocity ω of the crankshaft 22 every rotation of the crankshaft 22 by 30 CAD during the engine speed dropping, and computes a loss torque T during each 30 CAD rotation of the crankshaft 22. The ECU 20 stores the computed values of the loss torque T in its register RE (a register of the CPU) and/or the storage medium 20*a* while, for example, updating them every 180 CAD period.

For example, when a crank pulse is currently inputted to the ECU 20 at 30 CAD past the current TDC, that is, 30 ATDC, within the present 180 CAD period of the rotation of the crankshaft 22 at a current time CT (see FIG. 2), the ECU 20 has calculated:

a value ω[0, i−1] of the angular velocity ω at 0 CAD past the TDC of a previous cylinder (the previous TDC) in the firing order within the previous 180 CAD period of the rotation of the crankshaft 22;

a value ω[30, i−1] of the angular velocity ω at 30 CAD past the previous TDC within the previous 180 CAD period of the rotation of the crankshaft 22;

a value ω[60, i−1] of the angular velocity ω at 60 CAD past the previous TDC within the previous 180 CAD period of the rotation of the crankshaft 22;

a value ω[90, i−1] of the angular velocity ω at 90 CAD past the previous TDC within the previous 180 CAD period of the rotation of the crankshaft 22;

a value ω[120, i−1] of the angular velocity ω at 120 CAD past the previous TDC within the previous 180 CAD period of the rotation of the crankshaft 22;

a value ω[150, i−1] of the angular velocity ω at 150 CAD past the previous TDC within the previous 180 CAD period of the rotation of the crankshaft 22; and a value ω[0, i] of the angular velocity ω at 0 CAD past the TDC of the current cylinder (current TDC) within the current 180 CAD period of the rotation of the crankshaft 22.

Figure 2:
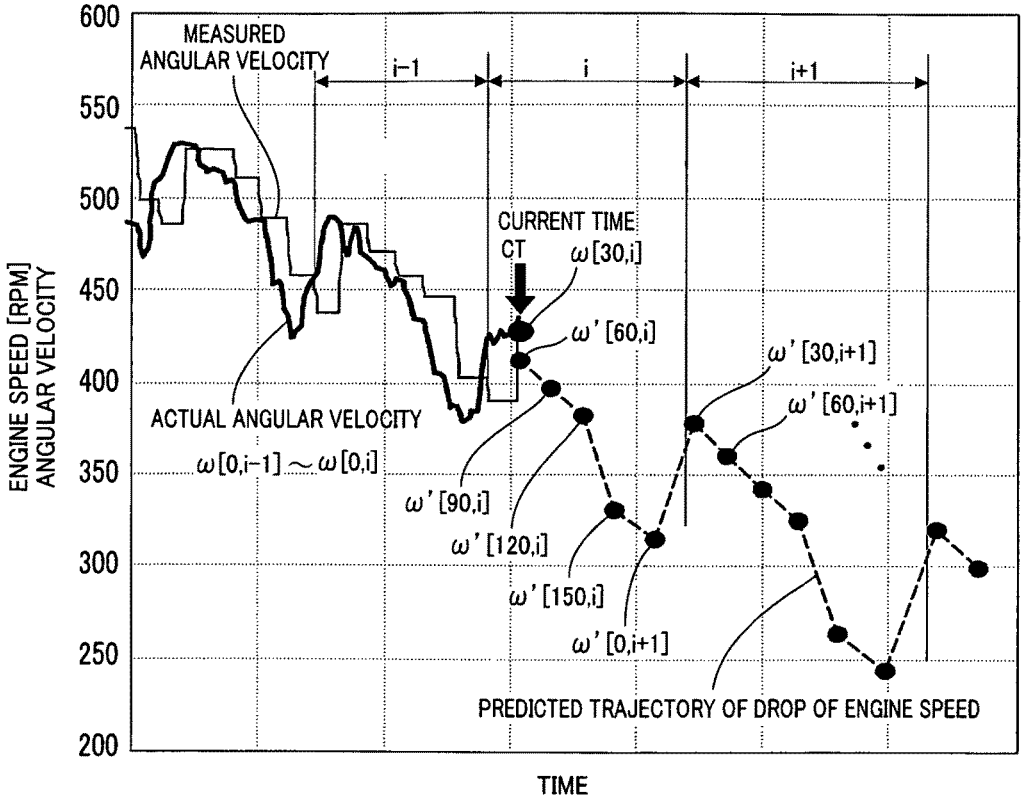
FIG. 2 is a timing chart schematically illustrating a predicted future trajectory of the drop of an engine speed achieved, as an example, by the engine control system according to the first embodiment.

The trajectory of the change in the angular velocity ω consisting of the calculated (measured) angular velocities and that of the change in an actual angular velocity are illustrated in FIG. 2.

The ECU 20 has computed a value of the loss torque T accordance with the following equations (2) to (7):

a value T[0-30, i−1] of the loss torque T from 0 CAD to 30 CAD past the previous TDC within the previous 180 CAD period of the rotation of the crankshaft 22;

a value T[30-60, i−1] of the loss torque T from 30 CAD to 60 CAD past the previous TDC within the previous 180 CAD period of the rotation of the crankshaft 22;

a value T[60-90, i−1] of the loss torque T from 60 CAD to 90 CAD past the previous TUC within the previous 180 CAD period of the rotation of the crankshaft 22;

a value T[90-120, i−1] of the loss torque T from 90 CAD to 120 CAD past the previous TDC within the previous 180 CAD period of the rotation of the crankshaft 22;

a value T[120-150, i−1] of the loss torque T from 120 CAD to 150 CAD past the previous TDC within the previous 180 CAD period of the rotation of the crankshaft 22; and a value T[150-0, i−1] of the loss torque T from 150 CAD past the previous TDC within the previous 180 CAD period of the rotation of the crankshaft 22 to 0 CAD past the current TDC within the current 180 CAD period of the rotation of the crankshaft 22.

$$T[0\text{-}30, i-1] = -J\cdot(\omega[30, i-1]^2 - \omega[0, i-1]^2)/2 \tag{2}$$

$$T[30\text{-}60, i-1] = -J\cdot(\omega[60, i-1]^2 - \omega[30, i-1]^2)/2 \tag{3}$$

$$T[60\text{-}90, i-1] = -J\cdot(\omega[90, i-1]^2 - \omega[60, i-1]^2)/2 \tag{4}$$

$$T[90\text{-}120, i-1] = -J\cdot(\omega[90, i-1]^2 - \omega[120, i-1]^2)/2 \tag{5}$$

$$T[120\text{-}150, i-1] = -J\cdot(\omega[150, i-1]^2 - \omega[120, i-1]^2)/2 \tag{6}$$

$$T[150\text{-}0, i-1] = -J\cdot(\omega[0, i]^2 - \omega[150, i-1]^2)/2 \tag{7}$$

where J represents inertia (the moment of inertia) of the engine 21.

Note that the loss torque T (loss energy E) means the change (reduction) of the rotational kinetic energy of the crankshaft 22 from a value of the angular velocity ω calculated by the ECU 20 to the next value of the angular velocity ω calculated by the ECU 20. That is, the loss torque T (loss energy E) means the loss of torque (energy) by the engine 21 at idle. The loss torque T (loss energy E) consists of the pumping loss torque (energy) and the friction loss torque (energy) of the engine 21, and the hydraulic loss torque (energy) of the transmission and an alternator and/or a compressor coupled to the crankshaft 22 via a belt or the like. Note that the loss energy E can be represented by dividing the loss torque T by J/2. For example, a value E[0-30, i−1] of the loss energy E from 0 CAD to 30 CAD past the previous TDC within the previous 180 CAD period of the rotation of the crankshaft 22 can be given as the following equation (8):

$$E[0\text{-}30,i-1]=-(\omega[30,i-1]^2-\omega[0,i-1]^2) \quad (8)$$

The ECU 20 has stored the values T[0-30, i−1], T[30-60, i−1], T[60-90, i−1], T[90-120, i−1], T[120-150, i−1], and T[150-0, i−1] of the loss torque T corresponding to the previous 180 CAD period of the rotation of the crankshaft 22 in its register RE (a register of the CPU) and/or the storage medium 20*a* (see FIG. 2), so that the previously stored values T[0-30, i−2], T[30-60, i−2], T[60-90, i−2], T[90-120, i−2], T[120-150, i−2], and T[150-0, i−2] of the loss torque T corresponding to the previous 180 CAD period of the rotation of the crankshaft 22 are updated.

In response to the currently inputted crank pulse at 30 CAD past the current TDC within the current 180 CAD period of the rotation of the crankshaft 22, the ECU 20 calculates a value ω[30, i] of the angular velocity ω at 30 CAD past the current TDC within the current 180 CAD period of the rotation of the crankshaft 22, and computes a value $T[0\text{-}30,i]=-J\cdot(\omega[30,i]^2-\omega[0,i]^2)/2$ of the loss torque T. Then, the ECU 20 stores the value T[0-30,i] of the loss torque T in its register RE while updating the value T[0-30, i−1] of the loss torque T.

Thereafter, the ECU 20 calculates, based on the value T[30-60,i−1] of the loss torque T from 30 CAD to 60 CAD past the previous TDC within the previous 180 CAD period of the crankshaft rotation, a predicted value ω'[60,i] of the angular velocity ω at 60 CAD past the current TDC within the current 180 CAD period of the crankshaft rotation in accordance with the following equation [9] (see FIG. 3):

$$\omega'^2[60, i] = \omega^2[30, i] - \frac{2}{J}T[30-60, i-1] \quad [9]$$

Based on the predicted value ω'[60,i] of the angular velocity ω, the ECU 20 calculates a predicted value t[30-60,i] of arrival time at which the crankshaft 22 will arrive at 60 CAD relative to 30 CAD in accordance with, the following equation [10]:

$$t[30-60, i] = \frac{2\pi\cdot 30}{360\cdot\omega'[60, i]} = \frac{\pi}{6\cdot\omega'[60, i]} \quad [10]$$

Next, the ECU 20 calculates, based on the value T[60-90,i−1] of the loss torque T from 60 CAD to 90 CAD past the previous TDC within the previous 180 CAD period of the crankshaft rotation, a predicted value ω'[90, i] of the angular velocity ω at 90 CAD past the current TDC within the current 180 CAD period of the crankshaft rotation in accordance with the following equation [11] (see FIG. 3):

$$\begin{aligned}\omega'^2[90, i] &= \omega'^2[60, i] - \frac{2}{J}T[60-90, i-1] \\ &= \omega^2[30, i] - \frac{2}{J}(T[30-60, i-1] + \\ &\quad T[60-90, i-1])\end{aligned} \quad [11]$$

Specifically, the predicted value ω'[90,i] of the angular velocity w is represented by the subtraction of the sum of the loss torque values between a predicted timing (90 CAD) and the current timing (30 CAD) from the current angular velocity ω[30, i].

Based on the predicted value ω'[90,i] of the angular velocity ω, the ECU 20 calculates a predicted value t[60-90, i] of the arrival time at which the crankshaft 22 will arrive at 90 CAD relative to 60 CAD in accordance with the following equation [12]:

$$t[60-90, i] = \frac{2\pi\cdot 30}{360\cdot\omega'[90, i]} = \frac{\pi}{6\cdot\omega'[90, i]} \quad [12]$$

Similarly, the ECU 20 calculates, based on the value T[90-120,i−1] of the loss torque T from 90 CAD to 120 CAD past the previous TDC within the previous 180 CAD period of the crankshaft rotation, a predicted value ω'[120,i] of the angular velocity ω at 120 CAD past the current TDC within the current 180 CAD period of the crankshaft rotation in accordance with the following equation [139] (see FIG. 3):

$$\begin{aligned}\omega'^2[120, i] &= \omega'^2[90, i] - \frac{2}{J}T[90-120, i-1] \\ &= \omega^2[30, i] - \frac{2}{J}(T[30-60, i-1] + \\ &\quad T[60-90, i-1] + T[90-120, i-1])\end{aligned} \quad [13]$$

Based on the predicted value ω'[120,i] of the angular velocity ω, the ECU 20 calculates a predicted value t[90-120,i] of the arrival time at which the crankshaft 22 will arrive at 120 CAD relative to 90 CAD in accordance with the following equation [14]:

$$t[90-120, i] = \frac{2\pi\cdot 30}{360\cdot\omega'[120, i]} = \frac{\pi}{6\cdot\omega'[120, i]} \quad [14]$$

That is, at the current time CT, the ECU 20 predicts what the angular velocity ω will be at intervals of 30 CAD of the rotation of the crankshaft 22, and what the arrival lime will be at intervals of 30 CAD of the rotation of the crankshaft 22, thus predicting the future trajectory of the drop of the angular velocity of the crankshaft 22, in other words, the drop of the engine speed (see FIG. 2). Data indicative of the predicted trajectory of the drop of the engine speed will be referred to as predicted data of the future trajectory of the drop of the engine speed.

Specifically, each time a crank pulse is inputted to the ECU 20 from the crank angle sensor 25, the ECU 20 is programmed to carry out the predictions of the angular velocity ω and the arrival time to thereby update the previous predicted data of the future trajectory of the drop of the engine speed to currently obtained predicted data thereof within the time interval between the crank pulse and the next crank pulse that will be inputted to the ECU 20 from the crank angle sensor 25.

Where feasible, the ECU 20 predicts the future trajectory of the drop of the engine speed until the last predicted value of the angular velocity ω is equal to or less than zero. If the next crank pulse is inputted to the ECU 20 from the crank angle sensor 25 before the last predicted value of the angular velocity ω reaches zero, the ECU 20 aborts the predictions of the angular velocity ω and the arrival time before the last predicted value of the angular velocity ω reaches zero, and carries out the predictions of the angular velocity ω and the arrival time in response to the receipt of the next crank pulse. Note that the ECU 20 can easily convert the angular velocity ω the crankshaft 22 (engine 21) into the engine speed, and can carry out the predictions of the engine speed and the arrival time in place of the angular velocity ω.

As described above, the ECU 20 according to the first embodiment is designed to energize the motor 12 of the starter 11 via the switching element 24 while adjusting the on period (pulse width) of the pulse current to be supplied to the switching element 24 in response to when at least one of the predetermined engine restart conditions is met, thus causing the pinion 13 (motor 12) to preliminarily rotate up to a predetermined maximum rotational speed (preset idle speed).

At that time, the ECU 20 is designed to predict a value of the rotational speed of the pinion 13 since the start of the rotation of the pinion 13 in response to, for example, the input of a crank pulse thereto from the crank angle sensor 25 to thereby predict the future trajectory of the increase of the rotational speed of the pinion 13 since the start of the rotation of the pinion 13; data indicative of the predicted trajectory of the increase of the rotational speed of the pinion 13 will be referred to as predicted data of the future trajectory of the increase of the rotational speed of the pinion 13. Then, the ECU 20 is designed to predict a timing to shift the pinion 13 to the ring gear 23 when the difference between a value of the predicted data of the future trajectory of the drop of the engine speed and a corresponding value of the predicted data of the future trajectory of the increase of the rotational speed of the pinion 13 will be within a preset value K1. This preset value K1 is for example set such that, when the pinion 13 is engaged with the ring gear 23 with the difference being within the preset value K1, noise due to the engagement is kept at a low level.

For example, the ECU 20 according to the first embodiment is designed to predict the future trajectory of the increase of the rotational speed of the pinion 13 since the start of the rotation of the pinion 13 using the following method. Specifically, the ECU 20 predicts the future trajectory of the increase of the rotational speed of the pinion 13 since the start of the rotation of the pinion 13 using the following model equation [15]; this equation is obtained beforehand by modeling the trajectory of the increase of the rotational speed of the pinion 13 with a first-order lag model with a predetermined time constant τ:

$$N_p = N_{pmax}\{1-\exp(-t\alpha/\tau)\} \quad [15]$$

where $N_n$ represents the rotational speed of the pinion 13, $N_{pmax}$ represents the previously determined maximum rotational speed of the pinion 13 corresponding to, for example, the idle speed, and tα represents an elapsed time since the start of the rotation of the pinion 13.

Note that it takes time until the pinion 13 has abutted onto the ring gear 23 since the start of the shift of the pinion 13 to the ring gear 23, and the time, referred to simply as "pinion shift time", is constant independently of the engine speed. Thus, the ECU 20 can predict a timing to shift the pinion 13 to the ring gear 23 earlier by the pinion shift time than a timing when the difference between a corresponding value of the predicted data of the future trajectory of the drop of the engine speed and a corresponding value of the predicted data of the future trajectory of the increase of the rotational speed of the pinion 13 is within a preset value K2. This preset value K2 is for example set such that, when the pinion 13 is engaged with the ring gear 23 with the difference being within the preset value K2, noise due to the engagement is kept at a low level.

Next, the trajectory prediction routine R1 to be executed by the ECU 20 will be described hereinafter with reference to FIG. 5A. The ECU 20 repeatedly runs the trajectory prediction routine R1 in a preset cycle during execution of the main engine control routine to function as means for predicting the future trajectory of the drop of the engine speed.

When launching the trajectory prediction routine R1, the ECU 20 determines whether at least one of predetermined engine automatic stop conditions is met, in other words, an engine automatic stop request (fuel-injection stop request) occurs based on the signals outputted from the sensors 59 in step 101.

Upon determining that no predetermined engine automatic stop conditions are met based on the signals outputted from the sensors 59 (NO in step 101), the ECU 20 exits the trajectory prediction routine R1 and returns to the main engine control routine.

Otherwise, upon determining that at least one of the engine automatic stop conditions is met (YES in step 101), the ECU 20 carries out automatic stop control of the engine 21 in step 101A.

Specifically, the ECU 20 controls the fuel injection system 51 and/or the ignition system 53 to stop the burning of the air-fuel mixture in each cylinder in step 101A. The stop of the burning of the air-fuel mixture in each cylinder of the engine 21 means the automatic stop of the engine 21. Because of the automatic stop of the engine 21, the crankshaft 22 of the engine 21 coasts based on, for example, its inertia.

In addition to the execution of step 101A, the ECU 20 determines whether a crank pulse is inputted thereto from the crank angle sensor 25 in step 102. The ECU 20 repeats the determination of step 102 upon determining that no crank pulses are inputted thereto (NO in step 102). That is, the ECU 20 proceeds to step 103 each time a crank pulse is inputted thereto.

In step 103, the ECU 20 calculates a value of the angular velocity ω of the crankshaft 22 corresponding to a currently inputted crank pulse thereto in accordance with the following equation (1) set forth above:

$$\omega[\text{rad/sec}] = \frac{30 \times 2\pi}{360 \times tp} \quad (1)$$

Note that a value of the angular velocity ω of the crankshaft 22 corresponding to an h CAD within the current 180 CAD period i of the rotation of the crankshaft 22 will be referred to as ω[h,i]. For example, a value of the angular velocity ω at 0 CAD past the current TDC within the current 180 CAD period i of the rotation of the crankshaft 22 is represented as ω[0,i].

Thereafter, the ECU 20 reads a value T[h−(h+30),i−1] of the loss torque T stored in the register RE in step 104; this value T[h−(h+30),i−1] of the loss torque T has been calculated to be stored in the register RE in step 107 described later, and corresponds to a crank pulse ω[h+30,i−1] that has been inputted to the ECU 20 150 CAD before the currently inputted crank pulse ω[h,i].

For example, when the currently inputted crank pulse corresponds to 60 CAD past the current TDC within the current 180 CAD period (i) of the rotation of the crankshaft 22, the ECU 20 reads a value T[60-90,i−1] of the loss torque 71 this value T[60-90,i−1] has been calculated to be stored in the register RE, and corresponds to a crank pulse ω[90, i−1] that has been inputted to the ECU 20 150 CA before the currently inputted crank pulsed ω[60,i] corresponding to 60 CAD (see FIG. 3).

Note that, when the currently inputted crank pulse corresponds to 60 CAD past the current TDC within the first 180 CAD period (i=1) of the rotation of the crankshaft 22 so that no values of the loss torque T have been stored in the register RE, a default value, which has been previously prepared as a value of the loss torque T from 60 CAD to 90 CAD of the crankshaft 22 and stored in the register RE or the storage medium 20*a*, can be used as the value T[60-90,i−1] of the loss torque T.

Next, the ECU 20 calculates, in accordance with the equation [9] or [11] set forth above, a predicted value ω'[h+30,i] of the angular velocity ω based on the value T[h−(h+30),i−1] of the loss torque T read from the register RE at the next input timing of a crank pulse corresponding to (h+30) CAD in step 105. For example, the operation in at least step 105 and an equivalent unit of the operation in at least step 105 correspond to a predictor according to the first embodiment of the present invention.

For example, in step 105, the ECU 20 calculates the predicted value ω'[h+30,i] of the angular velocity ω at the corresponding crank angle (h+30) of the crankshaft 22 within the current 180 CAD period i of the rotation of the crankshaft 22.

In step 105, the ECU 20 stores the predicted value ω'[h+30,i] of the angular velocity ω in the register RE or the storage medium 20*a*. Note that, when h+30=180, h+30 is set to 0 and i is incremented by "1".

For example, when the currently inputted crank pulse corresponds to 60 CAD, that is, the parameter h equals to 60, the ECU 20 calculates a predicted value ω'[90,i] of the angular velocity ω at the next input timing of a crank pulse corresponding to 90 CAD in accordance with the equation [11]:

$$\begin{aligned}\omega'^2[90, i] &= \omega'^2[60, i] - \frac{2}{J}T[60-90, i-1] \\ &= \omega^2[30, i] - \frac{2}{J}(T[30-60, i-1] + \\ &\quad T[60-90, i-1])\end{aligned} \tag{11}$$

In step 105, the ECU 20 calculates a predicted value of the arrival time t[h−(h+30),i] at which the crankshaft 22 will arrive at the next input timing of a crank pulse in accordance with the equation [10] set forth above, and stores the predicted value of the arrival time t in the register RE or the storage medium 20*a* in correlation with the predicted value ω'[h+30,i] of the angular velocity ω.

For example, when the currently inputted crank pulse corresponds to 60 CAD, the ECU 20 calculates a predicted value t[60-90,i] of the arrival time at which the crankshaft 22 will arrive at the next input timing of a crank pulse in accordance with the equation [12]:

$$t[60-90, i] = \frac{2\pi \cdot 30}{360 \cdot \omega'[90, i]} = \frac{\pi}{6 \cdot \omega'[90, i]} \tag{12}$$

Thereafter, the ECU 20 determines whether the predicted value ω'[h+30,i] of the angular velocity ω at the next input timing of a crank pulse corresponding to (h+30) CAD is equal to or less than zero to thereby determine whether to complete the prediction of the future trajectory of the drop of the engine speed up to the complete stop of the rotation of the crankshaft 22 in step 106. For example, the operation in at least step 106 and an equivalent unit of the operation in at least step 106 correspond to a determiner according to the first embodiment of the present invention.

Upon determining that the predicted value ω'[h+30,i] of the angular velocity ω at the next input timing of a crank pulse is more than zero (NO in step 106), the ECU 20 calculates a value T[(h−30)−h,i] of the loss torque T corresponding to the currently inputted crank pulse (h=30 CAD) thereto, and stores the value T[(h−30)−h,i] of the loss torque T in the register RE in step 107.

For example, when the currently inputted crank pulse corresponds to 60 CAD past the current TDC within the current 180 CAD period (i) of the rotation of the crankshaft 22, the ECU 20 calculates a value T[30-60,i] of the loss torque T corresponding to the currently inputted crank pulse thereto in accordance with the following equation [16]:

$$T[30\text{-}60,i]=-J\cdot(\omega[60,i]^2-\omega[30,i]^2)/2 \tag{16}$$

Following the completion of the operation in step 107, the ECU 20 increments the parameter h by 30, and, when the incremented value becomes 180, resets the incremented value to zero and increments the parameter i by 1 in step 107A. Thereafter, the ECU 20 returns to step 104 and repeats the operations in steps 104 to 107A until the determination in step 106 is affix/native. The repeat of the operations in steps 104 to 107A allows a lot of the predicted values ω' and a lot of the predicted values of the arrival time t to be calculated and stored in the register RE or the storage medium 20*a*.

During the repeat of the operations in steps 104 to 107A, when the currently predicted value ω' of the angular velocity ω is equal to or less than zero, the determination in step 106 is affirmative. Then, in step 106, the ECU 20 determines that the data set of a lot of the predicted values ω' of the angular velocity ω stored in the register RE or the storage medium 20*a* shows the future trajectory of the drop of the engine speed up to the complete stop of the rotation of the crankshaft 22. For example, the ECU 20 converts a lot of the predict values ω' of the angular velocity ω into a lot of predicted values of the engine speed, and generates, based on the predicted values of the engine speed, the future trajectory of the drop of the engine speed up to the complete stop of the rotation of the crankshaft 22.

Following the operation in step 106, the ECU 20 returns to step 102, and waits for the next input of a crank pulse from the crank angle sensor 25.

That is, the ECU 20 achieves the future trajectory of the drop of the engine speed up to the complete stop of the rotation of the crankshaft 22 while updating it each time a crank pulse is inputted from the crank angle sensor 25 thereto.

Note that, as described above, if the length of the interval between a currently inputted crank pulse and the next inputted crank pulse to the ECU 20 is shorter than the required time for the ECU 20 to complete the prediction of the future trajectory of the drop of the engine speed up to the complete stop of the rotation of the crankshaft 22, the ECU 20 is programmed to abort the prediction of the future trajectory of the drop of the engine speed at the currently inputted crank pulse, and carry out the next prediction of the future trajectory of the drop of the engine speed at the next inputted crank pulse.

Next, the starter control routine R2 to be executed by the ECU 20 will be described hereinafter with reference to FIG. 6. The ECU 20 repeatedly runs the starter control routine R2 in a preset cycle during execution of the main engine control routine to function as means for determining the timing to drive the pinion 13 for restart of the engine 21.

When launching the starter control routine R2, the ECU 20 determines whether at least one of the predetermined engine restart conditions is met, in other words, at least one engine restart request occurs, based on the signals outputted from the sensors 59 and the accessories 61 in step 201.

Upon determining that no predetermined engine restart conditions are met based on the signals outputted from the sensors 59 and the accessories 61 (NO in step 201), the ECU 20 exits the starter control routine R2 and returns to the main engine control routine.

Otherwise, upon determining that at least one of the engine restart conditions is met (YES in step 201), the ECU 20 determines whether the engine speed drops in step 202.

Upon determining that the engine speed does not drop, in other words, the rotation of the crankshaft 22 of the engine 21 is completely stopped (NO in step 202), the ECU 20 proceeds to step 208. In step 208, the ECU 20 energizes the pinion actuator 14 to shift the pinion 13 to the ring gear 23 so that the pinion 13 is engaged with the ring gear 23. At that time, because the ring gear 23 is not rotated, the engagement between the pinion 13 and the ring gear 23 is carried out with less noise. After the engagement of the pinion 13 with the ring gear 23, that is, after the lapse of a preset delay time since the energization of the pinion actuator 14, the ECU 20 energizes the motor 12 to rotate the pinion 13 to thereby crank the engine 21 up to, for example, the preset idle speed based on control of the duty cycle of the motor 12.

Otherwise, upon determining that the engine speed drops (YES in step 202), the ECU 20 proceeds to step 203. In step 203, the ECU 20 determines whether energization of the motor 12 is allowed by, for example, determining whether the engine speed is equal to or lower than a preset threshold speed. Upon determining that the engine speed is higher than the preset threshold speed so that energization of the motor 12 is not allowed (NO in step 203), the ECU 20 repeats the determination in step 203 until the engine speed becomes equal to or lower than the preset threshold speed.

Otherwise, upon determining that the engine speed is equal to or lower than the preset threshold speed so that energization of the motor 12 is allowed (YES in step 203), the ECU 20 proceeds to step 204, and starts to energize the motor 12 to rotate the pinion 13 up to the preset idle speed in step 204.

Thereafter, the ECU 20 predicts the future trajectory of the increase of the rotational speed of the pinion 13 since the start of the rotation of the pinion 13 using the model equation [15] obtained by modeling the trajectory of the increase of the rotational speed of the pinion 13 with the first-order lag model set forth above in step 205.

In step 205, the ECU 20 synchronizes the predicted data of the future trajectory of the drop of the engine speed with the predicted data of the future trajectory of the increase of the rotational speed of the pinion 13 such that an item of the predicted data of the future trajectory of the drop of the engine speed at a crank angle within a 180 CAD stroke of the crankshaft 22 is in alignment with an item of the predicted data of the future trajectory of the increase of the rotational speed of the pinion 13 at the same crank angle within the same 180 CAD stroke of the crankshaft 22.

Then, the ECU 20 predicts a timing to shift the pinion 13 to the ring gear 23 when the difference between a value of the predicted data of the future trajectory of the drop of the engine speed and a corresponding value of the predicted data of the future trajectory of the increase of the rotational speed of the pinion 13 will be within the preset value K1 in step 206. For example, the ECU 20 predicts, as the predicted timing to shift the pinion 13 to the ring gear 23, a predicted crank angle of the crankshaft 22 within a predicted 180 CAD stroke of the crankshaft 22.

Thereafter, in step 206, the ECU 20 determines whether a current crank angle of the crankshaft 22 within a current 180 CAD stroke of the crankshaft 22 corresponding to a currently input crank pulse thereto from the crank angle sensor 25 reaches the predicted timing (the predicted crank angle of the crankshaft 22 within the predicted 180 CAD stroke of the crankshaft 22). Upon determining that the current crank angle of the crankshaft 22 within the current 180 CAD stroke of the crankshaft 22 corresponding to a currently input crank pulse thereto from the crank angle sensor 25 does not reach the predicted timing (NO in step 206), the ECU 20 repeats the determination in step 206.

Otherwise, upon determining that the current crank angle of the crankshaft 22 within the current 180 CAD stroke of the crankshaft 22 corresponding to a currently input crank pulse thereto from the crank angle sensor 25 reaches the predicted timing (YES in step 206), the ECU 20 energizes the pinion actuator 14 to shift the pinion 13 to the ring gear 23 so that the pinion 13 is engaged with the ring gear 23 in step 207. This cranks the engine 21 to restart it. After the operation in step 207, the ECU 20 exits the starter control routine R2, and returns to the main engine control routine.

Note that, in step 206, the ECU 20 can predict a timing to shift the pinion 13 to the ring gear 23 earlier by the pinion shift time than a timing when the difference between a corresponding value of the predicted data of the future trajectory of the drop of the engine speed and a corresponding value of the predicted data of the future trajectory of the increase of the rotational speed of the pinion 13 is within the preset value K2. For example, the ECU 20 can convert the pinion shift time into an angular width of the rotation of the crankshaft 22 according to the current engine speed, and can predict a timing to shift the pinion 13 to the ring gear 23 earlier than the angular width of the rotation of the crankshaft 22. The preset value K1 can be set to be greater than the preset value K2 in consideration of, for example, the pinion shift time.

On the other hand, upon determining that no predetermined engine restart conditions are met during the engine speed dropping, the ECU 20 can determine whether the engine speed drops within a very low-speed range of, for example, 300 RPM or less, more specifically, 50 to 100 RPM, and, upon determining that the engine speed drops within the very low-speed range, the ECU 20 can energize the pinion actuator 14 to shift the pinion 13 to the ring gear 23. While the engine speed remains within the very low-speed range, each of the noise level at the engagement between the pinion 13 and the ring gear 23 and the abrasive wear therebetween can be maintained within an allowable range.

As described above, the engine control system 1 according to the first embodiment is configured to predict the future trajectory of the drop of the engine speed with fluctuation after the automatic stop of the engine 21. This configuration allows determination, with high accuracy, of the timing to shift the pinion 13 to the ring gear 23 even if the engine speed drops with fluctuation.

Figure 7:
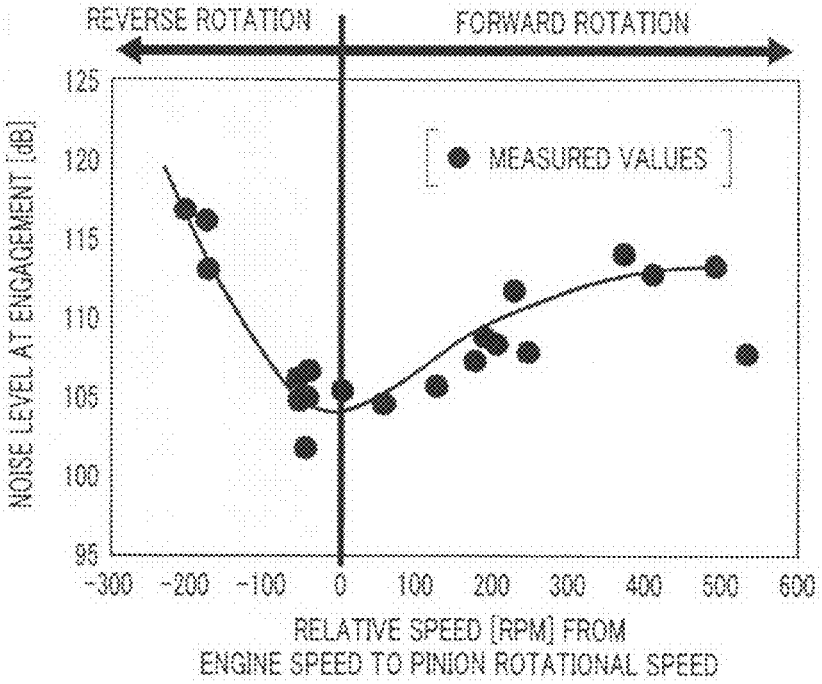
FIG. 7 is a graph on which the relationship between measured values of a relative speed from the engine speed to the rotational speed of the pinion and corresponding values of a noise level due to an engagement of the pinion with a ring gear at their measured values of the relative speed is plotted when the rotational speed of the pinion is set to zero according to the first embodiment.

In addition, the engine control system 1 according to the first embodiment is equipped with the starter 11 that individually energizes both the pinion actuator 14 for shifting the pinion 13 to the ring gear 23 and the motor 12 for turning the pinion 13. The engine control system 1 is also configured to start energization of the motor 12 at the occurrence of an engine stop request during the engine speed dropping to preliminarily rotate the pinion 13, predict the future trajectory of the increase of the rotation of the pinion 13, and predict a timing to shift the pinion 13 to the ring gear 23 when the difference between a value of the predicted data of the future trajectory of the drop of the engine speed and a corresponding value of the predicted data of the future trajectory of the increase of the rotational speed of the pinion 13 will be within a preset value preferably close to zero. FIG. 7 shows a graph on which the relationship between measured values of the relative speed from the engine speed to the rotational speed of the pinion 13 and corresponding values of the noise level due to the engagement of the pinion 13 with the ring gear 23 at their measured values of the relative speed is plotted when the rotational speed of the pinion 13 is set to zero.

This configuration predicts the timing when the rotational speed of the pinion 13 is substantially synchronized with the engine speed (the rotational speed of the ring gear 23) so that the relative speed is equal to or close to zero even if the engine speed drops with fluctuation. Thus, the ECU 20 determines the predicted timing as the timing to shift the pinion 13 to the ring gear 23, making it possible to increase the accuracy of determination of the timing to shift the pinion to the ring gear 23 to thereby reduce noise due to the engagement between the pinion 13 and the ring gear 23 (see FIG. 7).

Note that the ECU 20 according to the first embodiment is configured to carry out prediction of the future trajectory of the drop of the engine speed (angular velocity of the crankshaft 22) every 30 CAD of the rotation of the crankshaft 22, but the ECU 20 according to the first embodiment is not limited to the configuration.

Specifically, the ECU 20 can be configured to predict the future trajectory of the drop of the engine speed (angular velocity of the crankshaft 22) each time the piston in a cylinder reaches the TDC, in other words, each time the crankshaft 22 is rotated to reach a preset CAD corresponding to the TDC of a cylinder within a current 180 CAD stroke of the crankshaft 22, thus predicting the engine speed at the future timing when the piston in the next cylinder in the firing order will reach the next TDC in step 105. This configuration allows the ECU 20 to determine that the current timing corresponding to the current TDC is the last TDC during the forward rotation of the crankshaft 22 of the engine 21 when a value of the engine speed at the timing of the next TOG is a negative value (imaginary number). This is because, when the engine speed is close to zero after the piston in a cylinder passes the last TDC in the forward direction, the piston in the next cylinder in the firing order does not pass the next TDC, the engine 21 is rotated in the reverse direction. That is, the ECU 20 can determine that the engine speed will be a negative value, in other words, the rotation of the engine 21 will be reversed in direction within the next 180 CAD stroke of the crankshaft 22.

Figure 4:
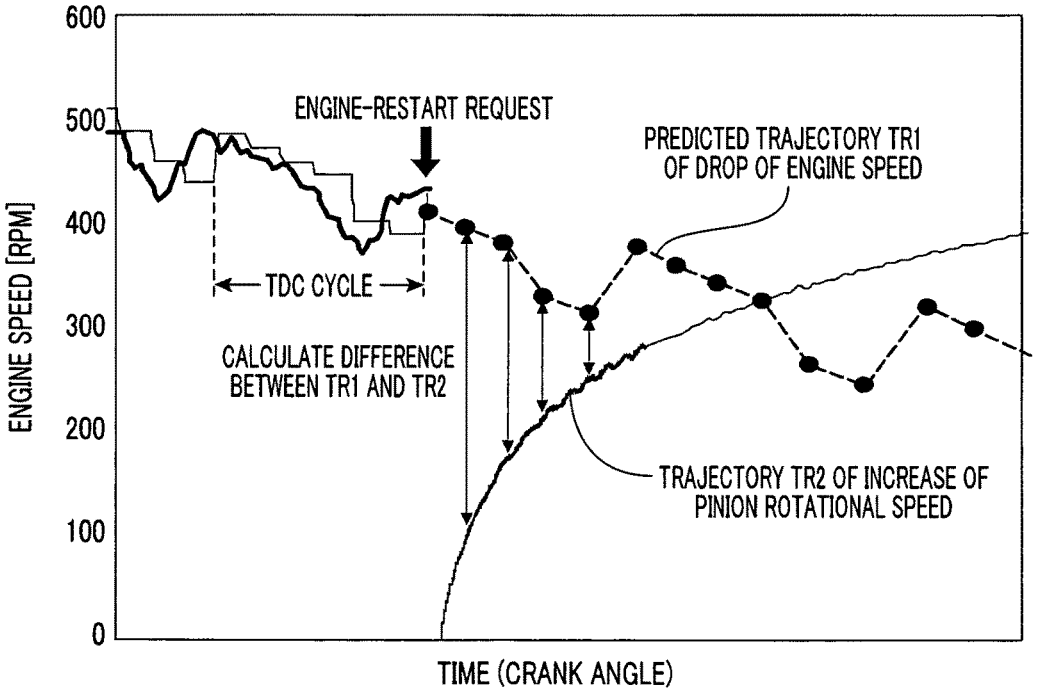
FIG. 4 is a graph schematically illustrating the relationship between the predicted future trajectory of the drop of the engine speed and that of the increase in a rotational speed of a pinion of a starter illustrated in FIG. 1.

Note that the cycle of fluctuation appearing in the trajectory of the drop of the engine speed coincides with the cycle of a piston passing the corresponding TDC; this cycle of a piston passing the corresponding TDC will be referred to as a "TDC cycle". This is because the engine speed is temporarily increased each time a piston reaches the TDC (see, for example, FIG. 4). Thus, it is effective for the ECU 20 to predict the future trajectory of the drop of the engine speed every TDC cycle.

Thus, the ECU 20 can predict the future trajectory of the drop of the engine speed every TDC cycle based on the trajectory of the loss torque T set forth above. Specifically, the ECU 20 can predict the future trajectory of the drop of the engine speed from the current TDC timing to the next TDC timing in step 105. In step 105, the ECU 20 can predict the future trajectory of the drop of the engine speed from the current TDC timing to the next TDC timing based on historical data indicative of the trajectory of the drop of the engine speed from the previous TDC timing to the current TDC timing. In place of every TDC cycle, the ECU 20 can predict the future trajectory of the drop of the engine speed each time the crankshaft 22 is located at the same CAD.

The ECU 20 according to the first embodiment predicts the future trajectory of the drop of the engine speed based on the future values of the angular velocity ω; these future values are at 30 CAD intervals corresponding to the intervals of the crank-pulse inputs, but the ECU 20 according to the first embodiment is not limited thereto. Specifically, the future values of the angular velocity ω at 30 CAD intervals may be strictly different from the actual trajectory of the drop of the engine speed. Thus, the ECU 20 can interpolate additional future values of the angular velocity ω during each 30 CAD interval corresponding to each interval of the crank-pulse inputs. This allows the predicted future trajectory of the drop of the engine speed containing the interpolated future values to be closer to the actual trajectory of the drop of the engine speed.

Second Embodiment

An engine control system according to the second embodiment of the present invention will be described hereinafter with reference to FIGS. 8 to 12.

The structure and/or functions of the engine control system according to the second embodiment are different from the engine control system 1 by the following points. So, the different points will be mainly described hereinafter.

The engine control system 1 according to the first embodiment is for example designed to predict a value of the angular velocity of the crankshaft 22 (engine speed) at the corresponding crank angle (h+30) of the crankshaft 22 within the current 180 CAD period i of the rotation of the crankshaft 22.

Figure 5B:
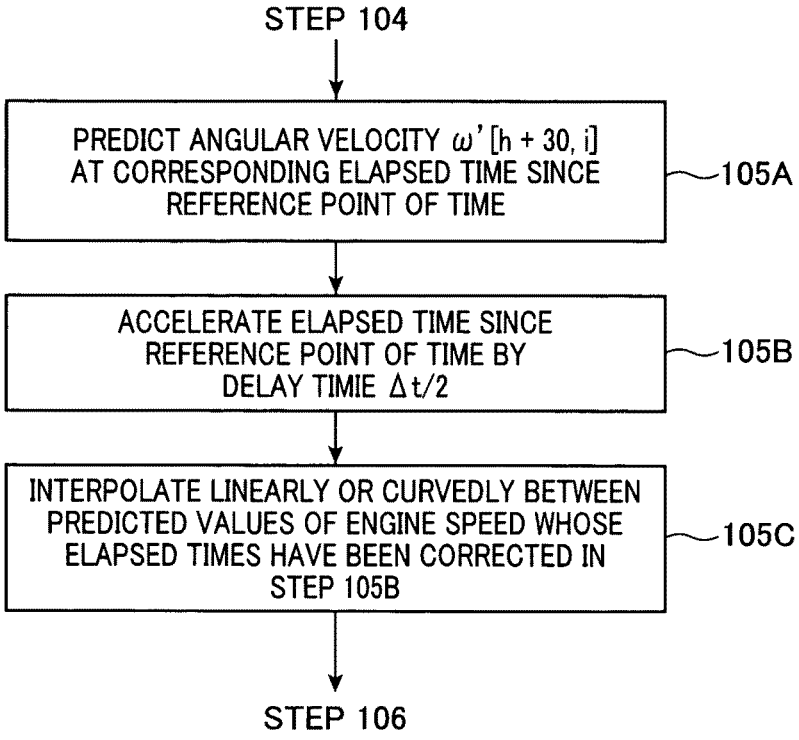
FIG. 5B is a flowchart schematically illustrating a part of another trajectory prediction routine to be executed by an ECU illustrated in FIG. 1 according to a modification of the first embodiment.

On the other hand, the engine control system according to the second embodiment is configured to calculate a predicted value ω'[h+30,i] of the angular velocity ω at a corresponding elapsed time since a predetermined reference point of time in step 105A of FIG. 5B.

Figure 6:
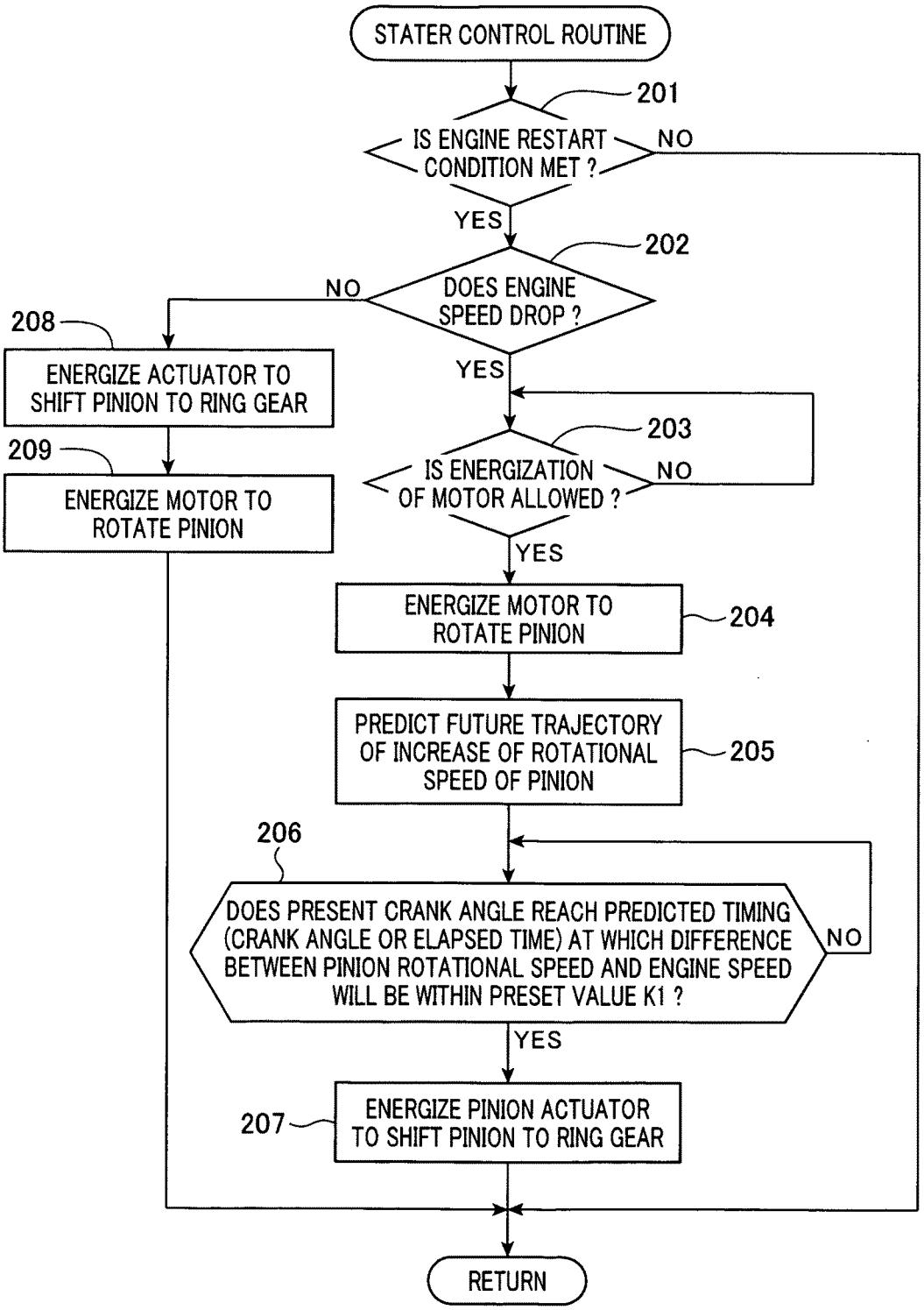
FIG. 6 is a flowchart schematically illustrating a starter control routine to be executed by the ECU according to the first embodiment.

Specifically, in step 105A, the ECU 20 calculates a predicted value ω'[h+30,i] of the angular velocity ω at the corresponding elapsed time since the predetermined reference point of time based on the predicted arrival time t[h−(h+30),i] corresponding to the predicted value ω'[h+30, i], and the previous elapsed time corresponding to the previous predicted arrival time t[(h−30)−h,i], and determines (predicts) the timing to shift the pinion 13 to the ring gear 23 as an elapsed time since the reference point of time in order to more simplify the process of predicting the future trajectory of the drop of the engine speed in step 206 in FIG. 6.

As the reference point of time, the engine control system according to the second embodiment has determined, for example, any one of:

a first point of time representing the start of cutting fuel into the engine 21 (each cylinder);

a second point of time when the engine speed drops up to a preset speed;

a third point of time representing the start of predicting the future trajectory of the drop of the engine speed; and a fourth point of time representing the occurrence of an engine restart request.

Figure 8:
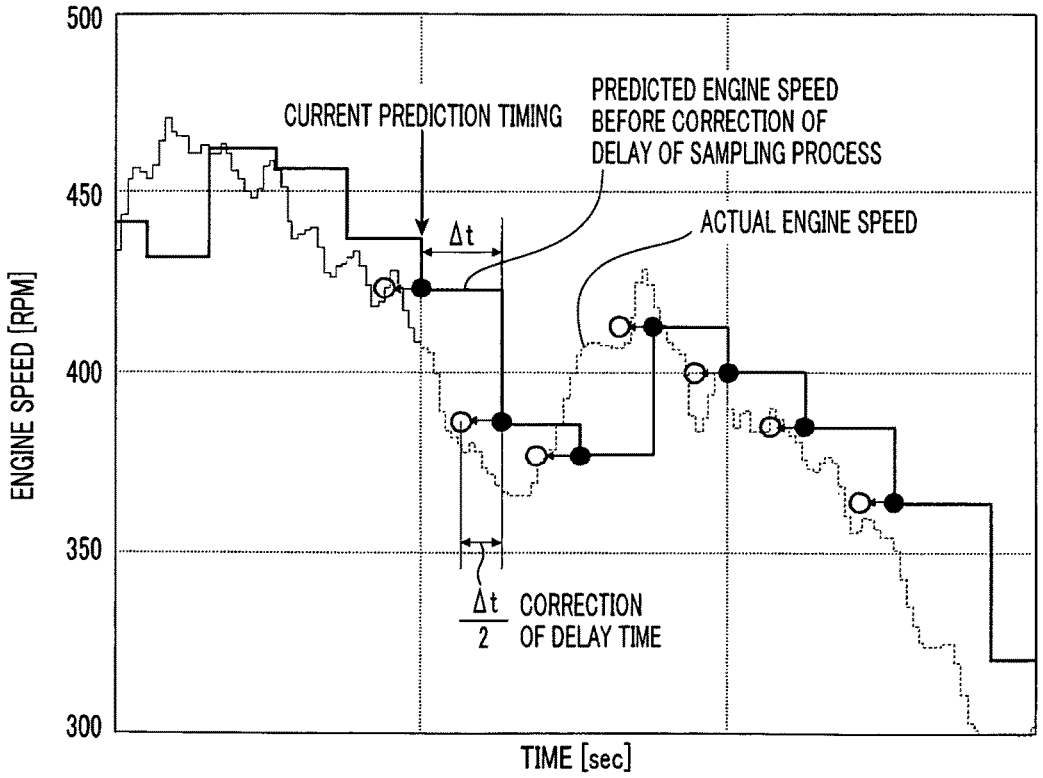
FIG. 8 is a timing chart schematically illustrating a relationship between the trajectory of the drop in an actual engine speed and that of the drop in a predicted engine speed before correction with delay therebetween according to the second embodiment of the present invention.
Figure 9:
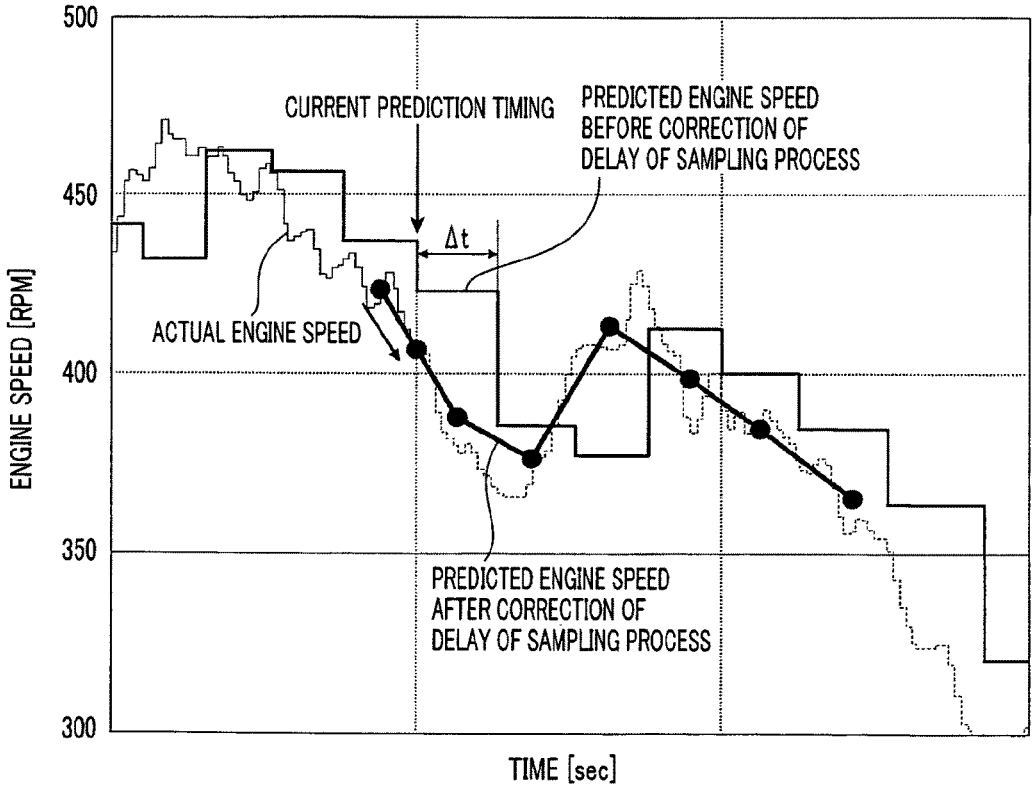
FIG. 9 is a timing chart schematically illustrating a relationship between the trajectory of the drop in the actual engine speed and that of the drop in the predicted engine speed after correction according to the second embodiment.

FIG. 8 is a timing chart schematically illustrating a relationship between the behavior of the change in the actual engine speed and that of the change in a predicted engine speed. As described above, because a value of the engine speed (angular velocity of the crankshaft 22 of the engine 21) is sampled every preset CAD, such as 30 CAD, of the rotation of the crankshaft 22, in other words, a value of the engine speed is sampled every input of a crank pulse from the crank angle sensor 25, the calculation of a predicted value of the engine speed is carried out every preset CAD of the rotation of the crankshaft 22. For this reason, the behavior of the change in the predicted engine speed is delayed relative to that of the change in the actual engine speed (see FIG. 8).

Thus, the engine control system according to the second embodiment is configured to accelerate the elapsed time of the predicted value of the engine speed since the reference point of time to compensate the delay due to the sampling process. Specifically, the ECU 20 accelerates the elapsed time of the predicted value $\omega'[h+30,i]$ of the angular velocity $\omega$ (predicted value of the engine speed) since the reference point of time by the half of the predicted arrival time $t[(h-30)-h,i]$; this predicted arrival time $t[(h-30)-h,i]$ corresponds to the interval (period) $\Delta t$ of the calculation of the predicted value of the engine speed in step 105B of FIG. 5B (see FIG. 8). The $\Delta t/2$ represents a delay time of the sampling process.

That is the engine control system according to the second embodiment is configured to change an elapsed time of predicted data of the future trajectory of the engine speed since the reference point of time earlier by a corresponding delay time of the sampling process.

Following the completion of the operation in step 105B, the ECU 20 of the engine control system according to the second embodiment is configured to interpolate linearly or curvedly between items of the predicted data (predicted values) of the engine speed whose elapsed times have been corrected in step 105B to thereby generate a continuous future trajectory as the future trajectory of the drop of the engine speed (see FIG. 9) in step 105C of FIG. 5B.

Figure 11:
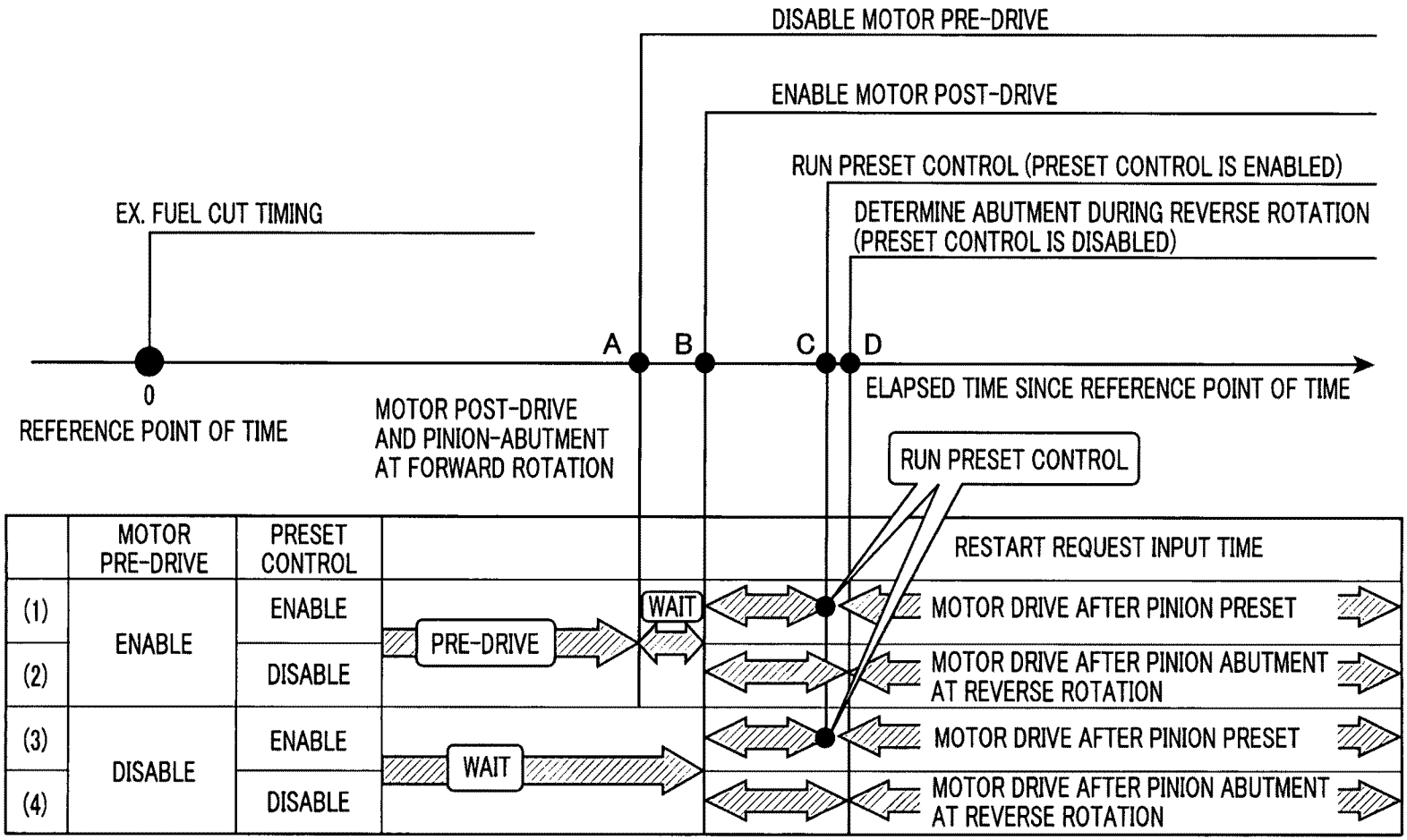
FIG. 11 is a timing chart schematically illustrating the relationship between each of the motor pre-drive disabling timing, the motor post-drive enabling timing, the pinion preset-control start timing, and the preset delay-time increasing timing and each of first to fourth operation modes of the ECU according to the second embodiment.

In addition, the engine control system according to the second embodiment is configured to determine, based on the predicted data of the future trajectory of the engine speed, any one of the following operation modes:

First operation mode representing a motor pre-drive mode in which pinion-preset control is enabled (see (1) of FIG. 11)

Second operation mode representing a motor pre-drive mode in which the pinion-preset control is disabled (see (2) of FIG. 11)

Third operation mode representing a motor post-drive mode in which the pinion-preset control is enabled (see (3) of FIG. 11)

Fourth operation mode representing a motor post-drive mode in which the pinion-preset control is disabled (see (4) of FIG. 11)

The motor pre-drive mode is an operation mode in which the ECU 20 preliminarily drives the motor 12 to rotate the pinion 13 before abutment of the pinion 13 onto the ring gear 23 in response to the occurrence of an engine restart request during the drop of the engine speed by the automatic stop of the engine 21.

That is, if the pinion 13 were shifted to the ring gear 23 while the pinion 13 is rotated based on the drive of the motor 12 within a relatively low-speed range of the engine speed, the rotational speed of the pinion 13 would be excessively higher than that of the ring gear 23 (engine speed). This would result in an increased noise level at the engagement of the pinion 13 with the ring gear 23, and/or in increased abrasive wear between the pinion 13 and the ring gear 23 to thereby reduce the durability of each of the pinion 13 and the ring gear 23.

In order to reliably avoid such circumstances, in the engine control system according to the second embodiment, a motor pre-drive disabling time A is previously set for disabling restart of the engine 21 in the motor pre-drive mode.

Specifically, as illustrated in FIG. 1Q a first engine-speed range SR1 from a lower limit of Ne4 [RPM] to an upper limit of, for example, zero (RPM) within which restart of the engine 21 in the motor pre-drive mode is allowed is previously defined on the continuous future trajectory of the drop of the engine speed generated by the ECU 20 in accordance with the trajectory prediction routine R1 set forth above.

When an elapsed time t(Ne4) since the reference point of time corresponds to the lower limit value Ne4 of the first engine-speed range SR1, the motor pre-drive disabling time A is set by a preset time t4 prior to the elapsed time t(Ne4) of the lower limit value Ne4 since the reference point of time. The preset time t4 corresponds to the pinion shift time taken from the start of the shift of the pinion 13 to the ring gear 23 to the abutment of the pinion 13 onto the ring gear 23. Note that time actually taken from the start of the shift of the pinion 13 to the ring gear 23 to the abutment of the pinion 13 onto the ring gear 23 is constant independently of the engine speed, but varies depending on its manufacturing process, its variation with time, and an operating environment of the engine control system according to the second embodiment, such as the battery-voltage fluctuation. For this reason, the preset time t4 can be preferably set to an upper limit (maximum value) of the range of the variations in the time actually taken from the start of the shift of the pinion 13 to the ring gear 23 to the abutment of the pinion 13 onto the ring gear 23.

Specifically, the ECU 20 according to the second embodiment can reliably avoid the restart of the engine 21 in the motor pre-drive mode when the engine speed is lower than the lower limit Ne4 of the first engine-speed range SRI (see "PRE-DRIVE" in (1) and (2) of FIG. 11).

The motor post-drive mode is an operation mode during the restart of the engine 21 in the motor pre-drive mode being disabled. Specifically, in the motor post-drive mode, the ECU 20 drives the motor 12 to rotate the pinion 13 after abutment of the pinion 13 onto the ring gear 23.

That is, if the motor 12 were driven after shift of the pinion 13 to the ring gear 23 within a relatively high-speed range of the engine speed, the rotational speed of the ring gear 23 (engine speed) would be excessively higher than that of the pinion 13. This would result in an increased noise level at the engagement of the pinion 13 with the ring gear 23, and/or in increased abrasive wear between the pinion 13 and the ring gear 23 to thereby reduce the durability of each of the pinion 13 and the ring gear 23.

In order to reliably avoid such circumstances, in the engine control system according to the second embodiment, a motor post-drive enabling time B is previously set for enabling restart of the engine 21 in the motor post-drive mode.

Figure 10:
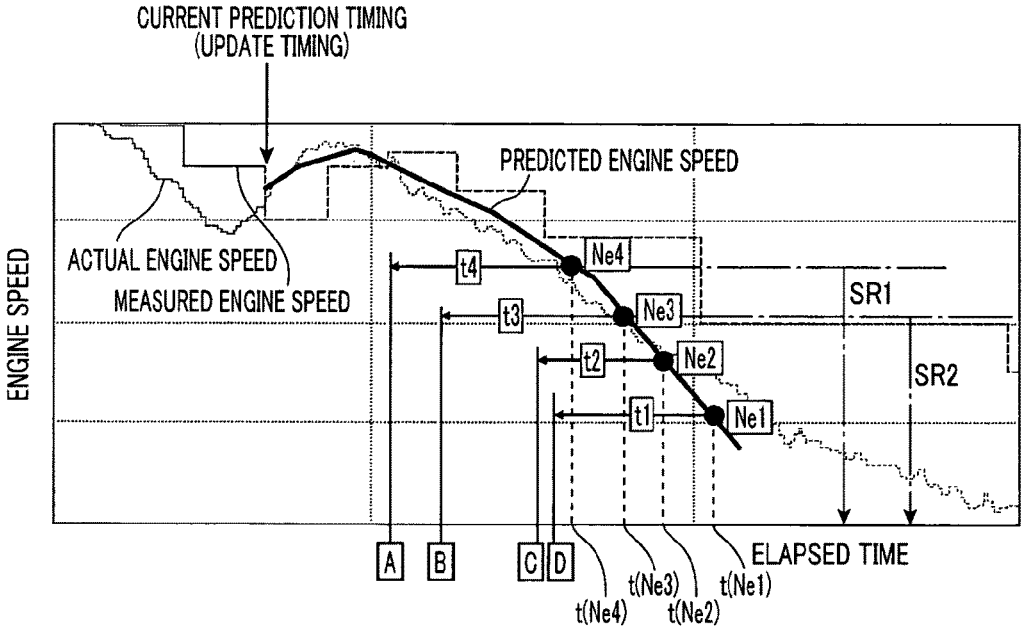
FIG. 10 is a timing chart schematically illustrating a motor pre-drive disabling timing, a motor post-drive enabling timing, a pinion preset-control start timing, and a preset delay-time increasing timing on the corrected trajectory of the drop in the predicted engine speed according to the second embodiment.

Specifically, as illustrated in FIG. 10, a second engine-speed range SR2 from an upper limit of Ne3 [RPM] to a preset lower limit within which restart of the engine 21 in the motor post-drive mode is allowed is previously defined on the continuous future trajectory of the drop of the engine speed generated by the ECU 20 in accordance with the trajectory prediction routine R1 set forth above.

When an elapsed time t(Ne3) since the reference point of time corresponds to the upper limit value Ne3 of the second engine-speed range SR2, the motor post-drive enabling time B is set by a preset time t3 prior to the elapsed time t(Ne3) of the upper limit value Ne3 since the reference point of time. The preset time t3 corresponds to the pinion shift time taken from the start of the shift of the pinion 13 to the ring gear 23 to the abutment of the pinion 13 onto the ring gear 23. The preset time t3 can be set as well as the preset time t4.

Specifically, the ECU 20 according to the second embodiment can reliably avoid the restart of the engine 21 in the motor post-drive mode when the engine speed is higher than the upper limit Ne3 of the second engine-speed range SR2 (see "WAIT" in (3) and (4) of FIG. 11).

Note that the upper limit Ne3 of the second engine-speed range SR2 illustrated in FIG. 10 is set to be lower than the lower limit Ne4 of the first engine-speed range SR1 illustrated in FIG. 10, but this is an example, and therefore, the upper limit Ne3 of the second engine-speed range SR2 can be set to be the same as the lower limit Ne4 of the first engine-speed range SRI.

The pinion-preset control is to shift the pinion 13 to the ring gear 23 so that the pinion 13 is abutted onto the ring gear 23 for restart of the engine 21 before an engine restart request occurs during the drop of the engine speed based on the automatic stop of the engine 21.

Specifically, in the engine control system according to the second embodiment, a preset-control start time C is previously set for executing the pinion-preset control if the pinion-preset control is enabled. Specifically, as illustrated in FIG. 10, a value Ne2 [RPM] of the engine speed at which the pinion-preset control is enabled is previously defined.

When an elapsed time t(Ne2) since the reference point of time corresponds to the value Ne2 of the engine speed on the continuous future trajectory of the drop of the engine speed generated by the ECU 20 in accordance with the trajectory prediction routine R1 set forth above, the preset-control start time C is set by a preset time t2 prior to the elapsed time t(Ne2) of the value Ne2 since the reference point of time; this preset time t2 corresponds to the pinion shift time taken from the start of the shift of the pinion 13 to the ring gear 23 to the abutment of the pinion 13 onto the ring gear 23. For example, the value Ne2 of the engine speed at which the pinion-preset control is enabled can be preferably set to maintain, within a corresponding allowable range, each of the noise level at the engagement between the pinion 13 and the ring gear 23 and the abrasive wear therebetween.

Specifically, the ECU 20 according to the second embodiment can reliably bring the pinion 13 to abut onto the ring gear 23 at a value of the engine speed equal to or close to the value Ne2 as a target engine speed of the pinion-preset control (see "RUN PRESET CONTROL" in (1) and (3) of FIG. 11).

Otherwise, if the pinion-preset control is disabled, the ECU 20 according to the second embodiment is configured to carry out the restart of the engine 21 in the motor post-drive mode as long as an engine restart request occurs during the engine speed dropping.

Note that, as described above, the crankshaft 22 of the engine 21 is rotated in the forward direction with the engine speed gradually dropping after the automatic stop of the engine 21. When the rotation of the crankshaft 22 of the engine 21 is temporarily stopped first, because the piston in a cylinder does not pass the next TDC, the crankshaft 22 of the engine 21 is rotated in the reverse direction. After the reverse rotation, the crankshaft 22 of the engine 21 is completely stopped. That is, such an unstable fluctuation appears in the trajectory of the rotation of the crankshaft 22 of the engine 21 before and after the rotation of the crankshaft 22 of the engine 21 is temporarily stopped first. For this reason, when the shift of the pinion 13 to the ring gear 23 is started before and after the crankshaft 22 of the engine 21 is temporarily stopped first, the pinion 13 may abut onto the ring gear 23 rotating in the reverse direction. In this case, because the pinion 13 may be hard to be engaged with the ring gear 23 rotating in the reverse direction, time (delay time) required for the pinion 13 to be completely engaged with the ring gear 23 since the start of the shift of the pinion 13 to the ring gear 23 may become longer.

In view of the points set forth above, in the engine control system according to the second embodiment, a preset delay-time increasing time D is previously set for increasing the delay time required for the pinion 13 to be completely engaged since the start of the shift of the pinion 13 to the ring gear 23 if the pinion-preset control is disabled.

Specifically, as illustrated in FIG. 10, when an elapsed time t(Ne1) since the reference point of time corresponds to a preset value Ne1 of the engine speed on the continuous future trajectory of the drop of the engine speed generated by the ECU 20 in accordance with, the trajectory prediction routine R1 set forth above, the preset delay-time increasing time D is set by a preset time t1 prior to the elapsed time t(Ne1) of the preset value Ne1 since the reference point of time. The preset time t1 corresponds to the pinion shift time taken from the start of the shift of the pinion 13 to the ring gear 23 to the abutment of the pinion 13 onto the ring gear 23. For example, the value Ne1 of the engine speed on the continuous future trajectory of the drop of the engine speed can be preferably set to zero [RPM] or a value [RPM] slightly higher than zero [RPM]. As well as the preset time t4, the preset time t1 can be preferably set to an upper limit (maximum value) of the range of the variations in the time actually taken from the start of the shift of the pinion 13 to the ring gear 23 to the abutment of the pinion 13 onto the ring gear 23.

Specifically, the ECU 20 according to the second embodiment can reliably increase the delay time within a range in which a predicted value of the engine speed is lower than the preset value Ne1 even if the time actually taken from the start of the shift of the pinion 13 to the ring gear 23 to the abutment of the pinion 13 onto the ring gear 23 varies. This reliably engages the pinion 13 with the ring gear 23 even during the reverse rotation of the engine 21 before the complete stop of the rotation of the engine 21 (see (2) and (4) of FIG. 11).

Note that the preset times t4, t3, t2, and t1 each corresponding to the pinion shift time taken from the start of the shift of the pinion 13 to the ring gear 23 to the abutment of the pinion 13 onto the ring gear 23, which are respectively used for calculating the elapsed times A, B, C, and D, can be set to be equal to each other. In this case, the values Ne1, Ne2, Ne3, and Ne4 used for determining any one of the first to fourth operation modes can be adjusted depending on the range of the variations in the time actually taken from the start of the shift of the pinion 13 to the ring gear 23 to the abutment of the pinion 13 onto the ring gear 23 and the specifications of the respective first to fourth operation modes.

Figure 12:
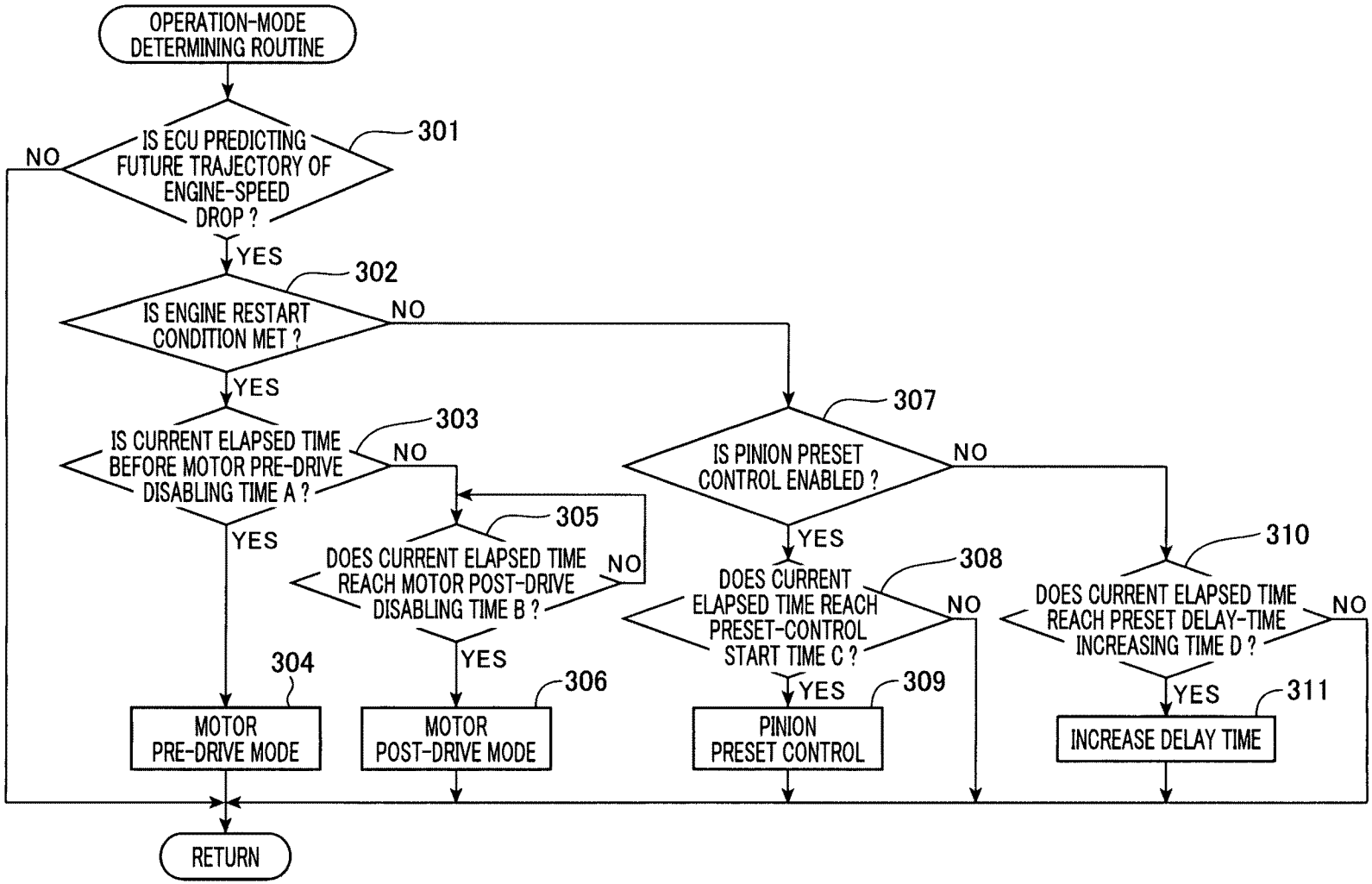
FIG. 12 is a flowchart schematically illustrating an operation-mode determining routine to be executed by the ECU according to the second embodiment.

The ECU 20 according to the second embodiment is designed to carry out an operation-mode determining routine R3 in accordance with the flowchart illustrated in FIG. 12 as part of the engine stop-and-start control routine. The ECU 20 repeatedly runs the operation-mode determining routine R3 in a preset cycle during execution of the main engine control routine to function as means for determining the timing to drive the pinion 13 for restart of the engine 21.

When launching the operation-mode determining routine R3, the ECU 20 determines whether it is predicting the future trajectory of the drop of the engine speed in accordance with the trajectory prediction routine R1 in step 301. Upon determining that the ECU 20 is not predicting the future trajectory of the drop of the engine speed (NO in step 301), the ECU 20 exits the operation-mode determining routine R3, and returns to the main engine control routine.

Otherwise, upon determining that the ECU 20 is predicting the future trajectory of the drop of the engine speed (YES in step 301), the ECU 20 determines whether at least one of the predetermined engine restart conditions is met, in other words, at least one engine restart request occurs, based on the signals outputted from the sensors 59 and the accessories 61 in step 302.

Upon determining that at least one of the engine restart conditions is met (YES in step 302), the ECU 20 determines whether a current elapsed time since the reference point of time is before the motor pre-drive disabling time A in step 303 to thereby determine whether the current elapsed time since the reference point of time is within an execution area in which the ECU 20 operates in the motor pre-drive mode.

Upon determining that the current elapsed time since the reference point of time is before the motor pre-drive disabling time A (YES in step 303), the ECU 20 determines that the current elapsed time since the reference point of time is within the execution area in which the ECU 20 operates in the motor pre-drive mode. Then, the ECU 20 operates in the motor pre-drive mode to execute the engine restart task in the motor pre-drive mode in step 304.

Specifically, in step 304, the ECU 20 drives the motor 12 to preliminarily rotate the pinion 13 before abutment of the pinion 13 onto the ring gear 23. Thereafter, when the current elapsed time since the reference point of time reaches a predicted timing when the difference between a value of the predicted data of the continuous future trajectory of the drop of the engine speed and a corresponding value of the predicted data of the future trajectory of the increase of the rotational speed of the pinion 13 will be within the preset value K1 (see step 206), the ECU 20 shifts the pinion 13 to the ring gear 23 to thereby engage the pinion 13 with the ring gear 23, cranking the engine 21 in step 304. After the operation in step 304, the ECU 20 exits the operation-mode determining routine R3, and returns to the main engine control routine.

Otherwise, upon determining that the current elapsed time since the reference point of time is equal to or after the motor pre-drive disabling time A (NO in step 303), the ECU 20 determines that the current elapsed time since the reference point of time is not within the execution area in which the ECU 20 operates in the motor pre-drive mode. Then, the ECU 20 determines whether the current elapsed time since the reference point of time reaches the motor post-drive enabling time B in step 305 to thereby determine whether the current elapsed time since the reference point of time is within an execution area in which the ECU 20 operates in the motor post-drive mode.

Upon determining that the current elapsed time since the reference point of time does not reach the motor post-drive enabling time B (NO in step 305), the ECU 20 waits until the current elapsed time since the reference point of time reaches the motor post-drive enabling time B. Thereafter, upon determining that the current elapsed time since the reference point of time reaches the motor post-drive enabling time B (YES in step 305), the ECU 20 determines that the current elapsed time since the reference point of time is within an execution area in which the ECU 20 operates in the motor post-drive mode. Then, the ECU 20 operates in the motor post-drive mode to execute the engine restart task in the motor post-drive mode set forth above in step 306.

Specifically, when the pinion preset control is enabled, the ECU 20 shifts the pinion 13 to the ring gear 23 to thereby engage the pinion 13 with the ring gear 23 in step 306 during the forward rotation of the ring gear 23. Thereafter, the ECU 20 drives the motor 12 to rotate the pinion 13 to thereby crank the engine 21 in step 306. After the operation in step 306, the ECU 20 exits the operation-mode determining routine R3, and returns to the main engine control routine.

Otherwise, upon determining that no engine restart conditions are met (NO in step 302), the ECU 20 determines whether the pinion preset control is enabled in step 307. Upon determining that the pinion preset control is enabled (YES in step 307), the ECU 20 determines whether the current elapsed time since the reference point of time reaches the preset-control start time C in step 308.

Upon determining that the current elapsed time since the reference point of time does not reach the preset-control start time C (NO in step 308), the ECU 20 exits the operation-mode determining routine R3, and returns to the main engine control routine, and repeatedly executes the operation-mode determining routine R3 every preset cycle.

Otherwise, upon determining that the current elapsed time since the reference point of time reaches the preset-control start time C (YES in step 308) at the k-th (k is an integer equal to or greater than 1) execution of the operation-mode determining routine R3, the ECU 20 executes the pinion preset control set forth above in step 309.

Specifically, the ECU 20 shifts the pinion 13 to the ring gear 23 to thereby engage the pinion 13 with the ring gear 23 in step 309. Thereafter, when an engine restart request occurs before the preset relay-time increasing time D, the ECU 20 drives the motor 12 to rotate the pinion 13 to thereby crank the engine 21 in step 309. After the operation in step 309, the ECU 20 exits the operation-mode determining routine R3, and returns to the main engine control routine.

Otherwise, upon determining that the pinion preset control is disabled (NO in step 307), the ECU 20 determines whether the current elapsed time since the reference point of time reaches the preset relay-time increasing time D in step 310.

Upon determining that the current elapsed time since the reference point of time does not reach the preset delay-time increasing time D (NO in step 310), the ECU 20 exits the operation-mode determining routine R3, and returns to the main engine control routine, and repeatedly executes the operation-mode determining routine R3 every preset cycle.

Otherwise, upon determining that the current elapsed time since the reference point of time reaches the preset delay-time increasing time D (YES in step 310) at the m-th (m is an integer equal to or greater than 1) execution of the operation-mode determining routine R3, the ECU 20 increases the delay time when executing the engine restart task in the motor post-drive mode set forth above in step 311. After the operation in step 311, the ECU 20 exits the operation-mode determining routine R3, and returns to the main engine control routine.

As described above, the engine control system according to the second embodiment is configured to predict the future trajectory of the drop of the engine speed as a function of elapsed time since the reference point of time, and determine (predict) each of the timing to shift the pinion 13 to the ring gear 23 and the timing to rotate the pinion 13 (the timing to drive the motor 12) as a corresponding elapsed time since the reference point of time. Thus, it is possible to simplify the timing to shift the pinion 13 to the ring gear 23 and that to rotate the pinion 13 with high accuracy.

In addition, the engine control system according to the second embodiment is configured to accelerate an elapsed time of predicted data of the future trajectory of the engine speed since the reference point of time by a corresponding delay time of the sampling process. This compensates the delay of the future trajectory of the engine speed due to the delay of the sampling processes, thus improving the accuracy of the prediction of the future trajectory of the drop of the engine speed.

Third Embodiment

An engine control system according to the third embodiment of the present invention will be described hereinafter with reference to FIGS. 13 and 14.

The structure and/or functions of the engine control system according to the second embodiment are different from the engine control system 1 by the following points. So, the different points will be mainly described hereinafter.

The engine control system according to the third embodiment is provided with means for generating an engagement disable request when the engine speed is rapidly changed during the prediction of the drop of the engine speed so that it cannot have a required level of the prediction accuracy of the timing to move the pinion 13 for restart of the engine 21; the engagement disable request is a request to disable the engagement between the pinion 13 and the ring gear 23. The generated engagement disable request causes the ECU 20 to stop or prevent the restart of the engine 21 during the drop of the engine speed.

That is, when the engine speed is rapidly changed during the prediction of the drop of the engine speed so that it cannot have a required level of the prediction accuracy of the timing to move the pinion 13 for restart of the engine 21, if the timing to move the pinion 13 for restart of the engine 21 were predicted so that the engine 21 were cranked by the movement of the pinion 13 at the predicted timing, the noise level at the engagement of the pinion 13 with the ring gear 23 would be increased and/or abrasive wear between the pinion 13 and the ring gear 23 would be increased to thereby reduce the durability of each of the pinion 13 and the ring gear 23.

In order to reliably avoid such circumstances, the engine control system according to the third embodiment is configured to cancel or prevent the restart of the engine 21 during the drop of the engine speed when the engagement disable request is generated. This configuration prevents the increase in the noise level at the engagement between the pinion 13 and the ring gear 23 and the reduction in the durability of each of the pinion 13 and the ring gear 23.

Note that let us consider a case where, while the ECU 20 operates in the motor pre-drive mode to execute the engine restart task, the engagement disable request is generated. In this case, if the ECU 20 stopped the drive of the motor 12, the pinion 13 might be halfway engaged with the ring gear 23 so that the pinion 13 and the ring gear 23 might idle with their being in friction. This might result in increased abrasive wear between the pinion 13 and the ring gear 23.

In order to reliably avoid such circumstances, the ECU 20 in the motor pre-drive mode is configured to:

cancel the shift of the pinion 13 to the ring gear 23 and stop the motor 12 when the engagement disable request is generated before the start of the shift of the pinion 13 to the ring gear 23; and ignore the engagement disable request to continue the engine restart task in the motor pre-drive mode when the engagement disable request is generated after the start of the shift of the pinion 13 to the ring gear 23.

The cancelling of the shift of the pinion 13 to the ring gear 23 when the engagement disable request is generated before the start of the shift of the pinion 13 to the ring gear 23 prevents the pinion 13 and the ring gear 23 from idling with their being in friction. This prevents the increase in abrasive wear of each of the pinion 13 and the ring gear 23, thus maintaining, at a sufficient level, the durability of each of the pinion 13 and the ring gear 23.

In addition, the reason why the continuation of the engine restart task in the motor pre-drive mode independently of the occurrence of the engagement disable request after the start of the shift of the pinion 13 to the ring gear 23 is that, after the shift of the pinion 13 to the ring gear 23, it is difficult to reliably stop the shift of the pinion 13 to the ring gear 23 before abutment of the pinion 13 onto the ring gear 23. In addition, because the difference in rotational speed between the pinion 13 and the ring gear 23 is relatively small immediately after the occurrence of the engagement disable request, it is relatively easy to engage the pinion 13 with the ring gear 23 immediately after the occurrence of the engagement disable request.

Figure 13:
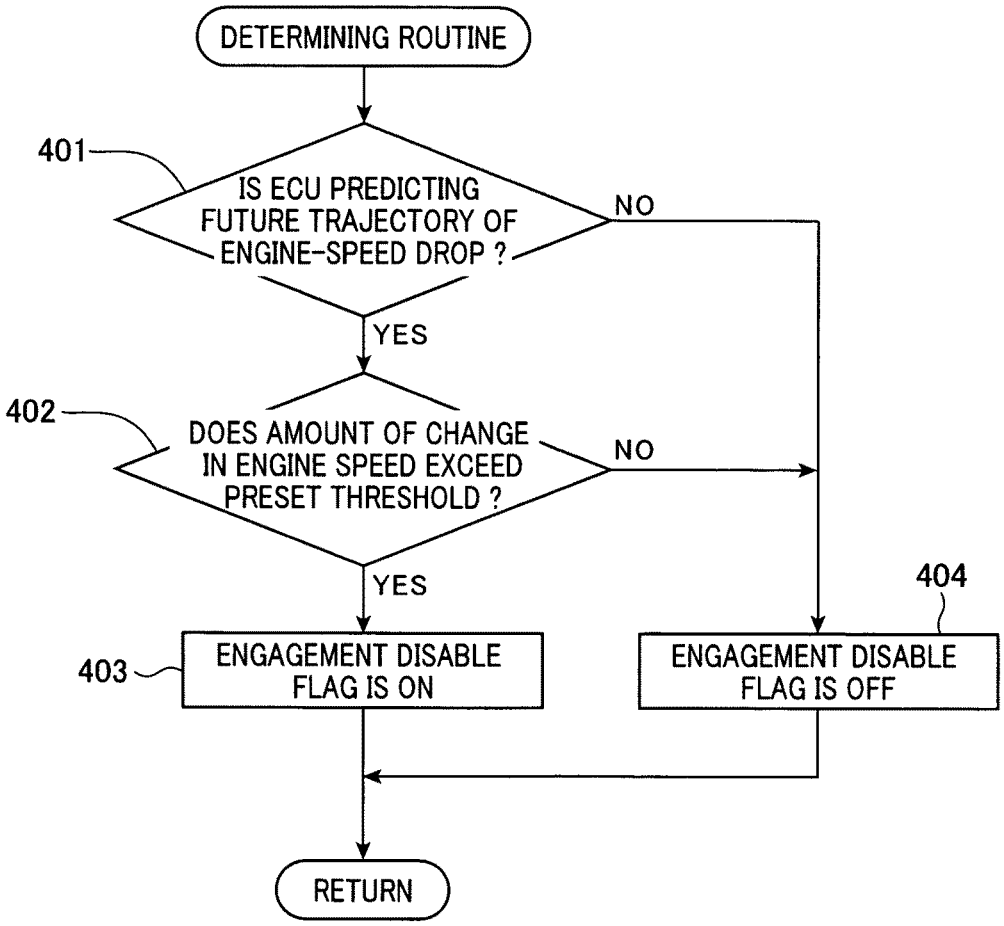
FIG. 13 is a flowchart schematically illustrating a determining routine of engagement disabling to be executed by the ECU according to the third embodiment of the present invention.

The ECU 20 according to the third embodiment is designed to carry out a determining routine of engagement disabling R4 in accordance with the flowchart illustrated in FIG. 13 as part of the engine stop-and-start control routine. The ECU 20 repeatedly runs the determining routine R4 in a preset cycle during execution of the main engine control routine.

When launching the determining routine R4, the ECU 20 determines whether it is predicting the future trajectory of the drop of the engine speed in accordance with the trajectory prediction routine R1 in step 401. Upon determining that the ECU 20 is not predicting the future trajectory of the drop of the engine speed (NO in step 401), the ECU 20 resets a first value indicative of ON and held in an engagement disable flag to a second value indicative of OFF, or maintains the second value held in the engagement disable flag, and thereafter, exits the determining routine R4, and returns to the main engine control routine. The engagement disable flag is in the form of, for example, a bit, and set by software in the ECU 20 each time the determining routine R4 is launched. The first value to be stored in the engagement disable flag represents disable of engagement between the pinion 13 and the ring gear 23, and the second value to be stored in the engagement disable flag represents enable of engagement between the pinion 13 and the ring gear 23. The second value indicative of OFF is set as default information of the engagement disable flag.

Otherwise, upon determining that the ECU 20 is predicting the future trajectory of the drop of the engine speed (YES in step 401), the ECU 20 determines whether the amount of change in the engine speed exceeds a preset threshold to thereby determine whether to ensure a required level of the prediction accuracy of the timing to move the pinion 13 for restart of the engine 21 in step 402. As the amount of change in the engine speed, the amount of fluctuation in the actual engine speed (measured engine speed) per unit of time, or the amount of fluctuation in the predicted engine speed per unit of time can be used.

Upon determining that amount of change in the engine speed exceeds the preset threshold (YES in step 402), the ECU 20 determines that the required level of the prediction accuracy of the timing to move the pinion 13 for restart of the engine 21 cannot be ensured. Then, the ECU 20 changes the second value indicative of OFF and held in the engagement disable flag to the first value indicative of ON in step 403. Thereafter, the ECU 20 exits the determining routine R4 and returns to the main engine control routine.

Otherwise, upon determining that amount of change in the engine speed does not exceed the preset threshold (NO in step 402), the ECU 20 determines that the required level of the prediction accuracy of the timing to move the pinion 13 for restart of the engine 21 can be ensured. Then, the ECU 20 resets the first value held in an engagement disable flag to the second value, or maintains the second value held in the engagement disable flag, and thereafter, returns to the main engine control routine.

Figure 14:
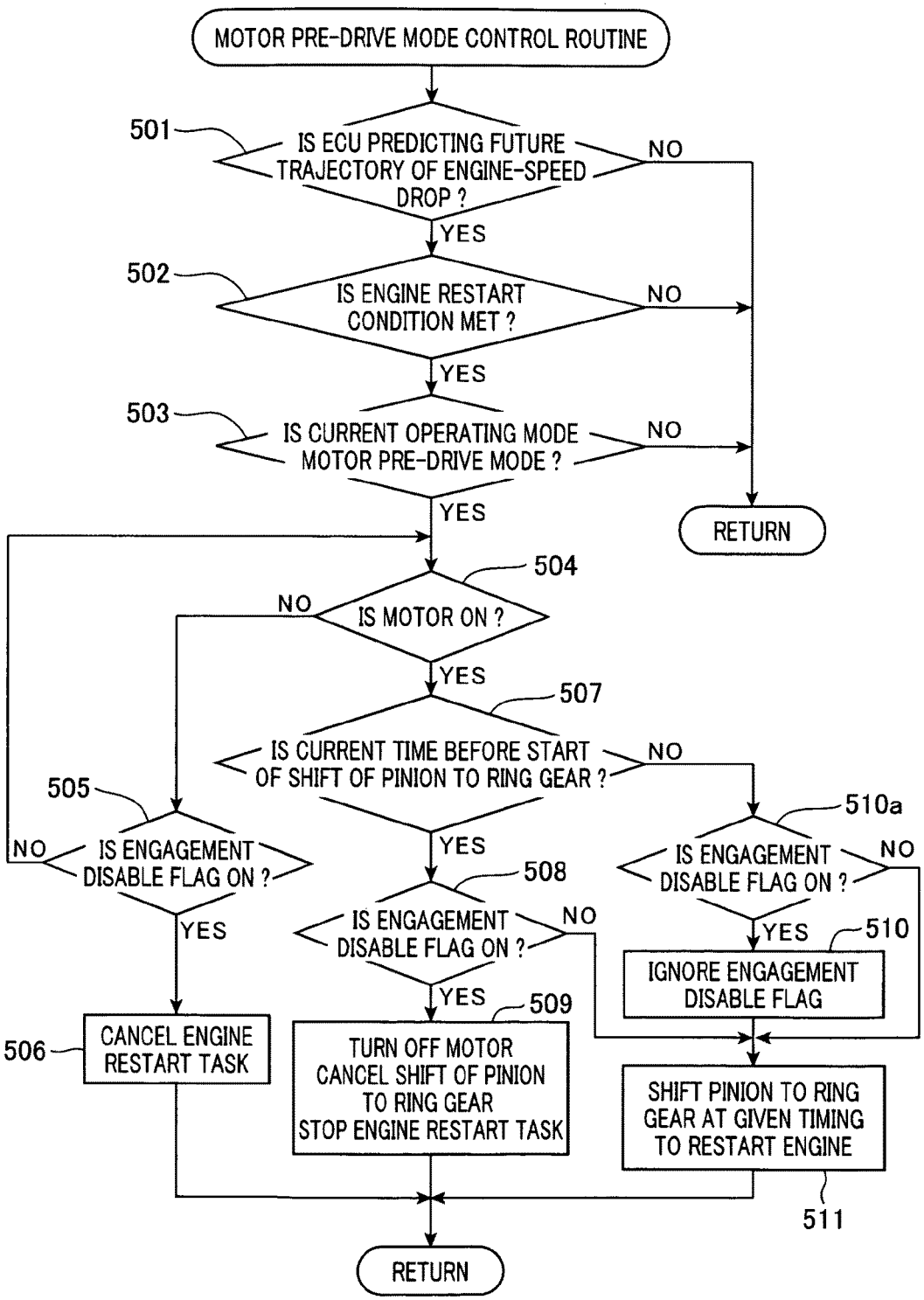
FIG. 14 is a flowchart schematically illustrating a motor pre-drive mode control routine to be executed by the ECU according to the third embodiment.

The ECU 20 according to the third embodiment is designed to carry out a motor pre-drive mode control routine R5 in accordance with the flowchart illustrated in FIG. 14 as part of the starter control task R2. The ECU 20 repeatedly runs the motor pre-drive mode control routine R5 in a preset cycle during execution of the main engine control routine.

When launching the motor pre-drive mode control routine R5, the ECU 20 determines whether it is predicting the future trajectory of the drop of the engine speed in accordance with the trajectory prediction routine R1 in step 501. Upon determining that the ECU 20 is not predicting the future trajectory of the drop of the engine speed (NO in step 501), the ECU 20 exits motor pre-drive mode control routine R5 and returns to the main engine control routine.

Otherwise, upon determining that the ECU 20 is predicting the future trajectory of the drop of the engine speed (YES in step 501), the ECU 20 determines whether at least one of the predetermined engine restart conditions is met, in other words, at least one engine restart request occurs, based on the signals outputted from the sensors 59 and the accessories 61 in step 502.

Upon determining that no predetermined engine restart conditions are met based on the signals outputted from the sensors 59 and the accessories 61 (NO in step 502), the ECU 20 exits the motor pre-drive mode control routine R5 and returns to the main engine control routine.

Otherwise, upon determining that at least one of the predetermined engine restart conditions is met (YES in step 502), the ECU 20 determines whether its current operating mode is the motor pre-drive mode in step 503. Upon determining that its current operating mode is not the motor pre-drive mode (NO in step 503), the ECU 20 exits the motor pre-drive mode control routine R5 and returns to the main engine control routine. Otherwise, upon determining that its current operating mode is the motor pre-drive mode (YES in step 503), the ECU 20 proceeds to step 504.

In step 504, the ECU 20 determines whether the motor 12 is activated (ON). Upon determining that the motor 12 is inactivated (OFF) (NO in step 504), the ECU 20 determines whether the first value (disabling of engagement) is held in the engagement disable flag in step 505. Upon determining that the second value (enabling of engagement) is held in the engagement disable flag (NO in step 505), the ECU 20 returns to step 504, and repeats the determination in step 504.

Otherwise, upon determining that the first value (disabling of engagement) is held in the engagement disable flag (YES in step 505), the ECU 20 cancels the engine restart task in the motor pre-drive rode, and thereafter exits the motor pre-drive mode control routine R5 in step 506, returning to the main engine control routine.

On the other hand, upon determining that the motor 12 is activated (ON) (YES in step 504), the ECU 20 proceeds to step 507, and determines whether the current time is before the start of the shift of the pinion 13 to the ring gear 23 in step 507. Upon determining that the current time is before the start of the shift of the pinion 13 to the ring gear 23 (YES in step 507), the ECU 20 determines whether the first value (disabling of engagement) is held in the engagement disable flag in step 508. Upon determining that the first value (disabling of engagement) is held in the engagement disable flag (YES in step 508), the ECU 20 determines that the engagement disable request is generated before the start of the shift of the pinion 13 to the ring gear 23. Then, the ECU 20 turns off the motor 12 and is cancels the shift of the pinion 13 to the ring gear 23 to stop the engine restart task in the motor pre-drive mode in step 509. Thereafter, the ECU 20 exits the motor pre-drive mode control routine R5, returning to the main engine control routine.

Otherwise, upon determining that the second value (enabling of engagement) is held in the engagement disable flag (NO in step 508), the ECU 20 proceeds to step 511, and starts to shift the pinion 13 to the ring gear 23 at a given timing to thereby execute the engine restart task in the motor pre-drive mode in step 511. After the completion of the engine restart task, the ECU 20 exits the motor pre-drive mode control routine R5, returning to the main engine control routine.

On the other hand, upon determining that the current time is after the start of the shift of the pinion 13 to the ring gear 23 (NO in step 507), the ECU 20 determines whether the engagement disable flag is changed from the second value (enabling of engagement) to the first value (disabling engagement) in step 510*a*. Upon determining that the engagement disable flag is changed from the second value (enabling of engagement) to the first value (disabling engagement) (YES in step 510*a*), the ECU 20 ignores the engagement disable flag with the first value in step 510*a*, and starts to shift the pinion 13 to the ring gear 23 at a given timing to thereby execute the engine restart task in the motor pre-drive mode in step 511, which is the same in the case of NO in step 510*a*. After the completion of the engine restart task, the ECU 20 exits the motor pre-chive mode control routine R5, returning to the main engine control routine.

As described above, the engine control system according to the third embodiment is configured to cancel or prevent the restart of the engine 21 during the drop of the engine speed when the engagement disable request is generated. This configuration prevents the increase in the noise level at the engagement between the pinion 13 and the ring gear 23 and the reduction in the durability of each of the pinion 13 and the ring gear 23.

The configuration of cancelling or preventing the restart of the engine 21 during the drop of the engine speed when the engagement disable request is generated can be applied to the motor post-drive mode.

Fourth Embodiment

An engine control system according to the fourth embodiment of the present invention will be described hereinafter with reference to FIGS. 15 and 16. The structure and/or functions of the engine control system according to the fourth embodiment are different from the engine control system 1 by the following points. So, the different points will be mainly described hereinafter.

As described above, after the crankshaft 22 is rotated in the forward direction so that the piston in a cylinder passes the last TDC during the drop of the engine speed in the forward rotation of the crankshaft 22, because the piston in the next cylinder in the firing order does not pass the next TDC, the engine speed will be zero [RPM] or less before the crankshaft 22 is rotated up to a CAD corresponding to the next TDC timing.

Thus, the ECU 20 according to the fourth embodiment is configured to determine, based on the predicted future trajectory of the engine speed up to zero [RPM], the timing, referred to "last TDC timing", when the piston in a cylinder reaches the last TDC before the engine speed reaches zero [RPM] in the forward rotation of the crankshaft 22. The ECU 20 according to the fourth embodiment is configured to determine the timing to energize (drive) the motor 12 and/or the timing to drive the pinion 13 to shift it to the ring gear 23 relative to the last TDC timing.

The ECU 20 according to the fourth embodiment can also be configured to predict the future trajectory of the drop of the engine speed (angular velocity of the crankshaft 22) every TDC cycle or every 180 CAD cycle, and to determine whether the engine speed predicted at the next TDC liming is zero [RPM] or less, thus determining whether the current TDC corresponds to the last TDC based on the result of the determination of whether the engine speed predicted at the next TDC timing is zero [RPM] or less.

For example, in response to the currently inputted crank pulse at, for example, 30 CAD past the current TDC within the current 180 CAD period of the rotation of the crankshaft 22, the ECU 20 calculates a value ω[30, i] of the angular velocity ω at 30 CAD past the current TDC within the current 180 CAD period of the rotation of the crankshaft 22, and computes a value $T[0\text{-}30,i]=-J\cdot(\omega[30,i]^2-\omega[0,i]^2)/2$ of the loss torque T. Then, the ECU 20 stores the value T[0-30, i] of the loss torque T in its register RE while updating the value T[0-30,i−1] of the loss torque T.

Thereafter, the ECU 20 calculates, based on the value T[30-60,i−1] of the loss torque T from 30 CAD to 60 CAD past the previous TDC within the previous 180 CAD period of the crankshaft rotation, a predicted value ω'[60, i] of the angular velocity ω at 60 CAD past the current TDC within the current 180 CAD period of the crankshaft rotation in accordance with the aforementioned equation [9] (see FIG. 3):

$$\omega'^2[60, i] = \omega^2[30, i] - \frac{2}{J}T[30-60, i-1] \quad [9]$$

Based on the predicted value ω'[60,i] of the angular velocity ω, the ECU 20 calculates a predicted value t[30-60,i] of arrival time at which the crankshaft 22 will arrive at 60 CAD relative to 30 CAD in accordance with the aforementioned equation [10]:

$$t[30-60, i] = \frac{2\pi\cdot 30}{360\cdot\omega'[60, i]} = \frac{\pi}{6\cdot\omega'[60, i]} \quad [10]$$

Next, the ECU 20 calculates, based on the value T[60-90,i−1] of the loss torque T from 60 CAD to 90 CAD past the previous TDC within the previous 180 CAD period of the crankshaft rotation and the predicted value ω'[60,i] of the angular velocity ω, a predicted value ω'[90,i] of the angular velocity ω at 90 CAD past the current TDC within the current 180 CAD period of the crankshaft rotation in accordance with the aforementioned equation [11] (see FIG. 3):

$$\omega'^2[90, i] = \omega'^2[60, i] - \frac{2}{J}T[60-90, i-1] \quad [11]$$

Based on the predicted value ω'[90,i] of the angular velocity ω the ECU 20 calculates a predicted value t[60-90, i] of the arrival time at which the crankshaft 22 will arrive at 90 CAD relative to 60 CAD in accordance with the aforementioned equation [12]:

$$t[60-90, i] = \frac{2\pi\cdot 30}{360\cdot\omega'[90, i]} = \frac{\pi}{6\cdot\omega'[90, i]} \quad [12]$$

That is, at the current time corresponding 30 ATDC within the current 180 CAD period of the crankshaft rotation, the ECU 20 predicts a value of the angular velocity ω and a value of the arrival time at the next prediction timing (30 CAD after the current timing) based on: the corresponding value of the loss torque T stored in the register RE, the current engine speed (current angular velocity of the crankshaft 22), and the inertia J of the engine 21. Thereafter, the ECU 20 repeats the prediction of a value of the angular velocity to and that of a value of the arrival time every 180 CAD cycle based on: the previous predicted value of the angular velocity, the corresponding value of the loss torque T stored in the register RE, and the inertia J of the engine 21 (see FIG. 3).

Figure 15:
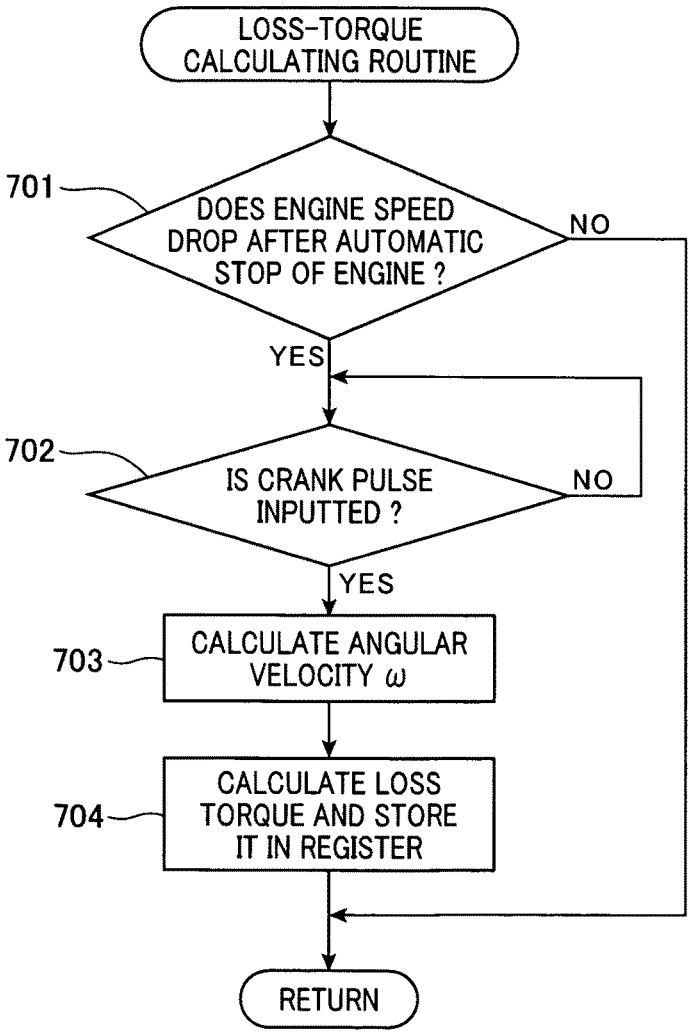
FIG. 15 is a flowchart schematically illustrating a loss-torque calculating routine to be executed by the ECU according to the fourth embodiment of the present invention.

The ECU 20 according to the fourth embodiment is designed to carry out a loss-torque calculating routine R6 in accordance with the flowchart illustrated in FIG. 15 as part of the engine stop-and-start control routine. The ECU 20 repeatedly runs the loss-torque calculating routine R6 in a preset cycle during execution of the main engine control routine. The ECU 20 calculates a value of the loss torque T each time a crank pulse is inputted thereto from the crank angle sensor 25, and stores the value of the loss torque T in its register RE and/or the storage medium 20*a* while, for example, updating it every 180 CAD period.

Specifically, when launching the loss-torque calculating routine R6, the ECU 20 determines whether the engine speed drops after automatic stop of the engine 21 in step 701. Upon determining that the engine speed does not drop after automatic stop of the engine 21 or the engine speed drops with the engine 21 being activated (NO in step 701), the ECU 20 exits the loss-torque calculating routine R6 because of no need to calculate the loss torque T used to predict the future trajectory of the drop of the engine speed, returning to the main engine control routine.

Otherwise, upon determining that the engine speed drops after automatic stop of the engine 21 (YES in step 701), the ECU 20 determines whether a crank pulse is inputted thereto from the crank angle sensor 25 in step 702. The ECU 20 repeats the determination of step 702 upon determining that no crank pulses are inputted thereto (NO in step 702). That is, the ECU 20 proceeds to step 703 each time a crank pulse is inputted thereto.

In step 703, the ECU 20 calculates a value of the angular velocity ωof the crankshaft 22 corresponding to a currently inputted crank pulse thereto in accordance with the following equation (1) set forth above:

$$\omega[\text{rad/sec}] = \frac{30 \times 2\pi}{360 \times tp} \tag{1}$$

As well as the first embodiment, note that a value of the angular velocity ω of the crankshaft 22 corresponding to an h CAD within the present 180 CAD period i of the rotation of the crankshaft 22 will be referred to as ω[h,i]. For example, a value of the angular velocity ω at 0 CAD past the current TDC within the current 180 CAD period i of the rotation of the crankshaft 22 is represented as ω[0,i].

In step 704, the ECU 20 calculates a value T[(h−30)−h,i] of the loss torque T corresponding to the currently inputted crank pulse thereto, and stores the value T[(h−30)−h,i] of the loss torque T in the register RE or the storage medium 20*a* while updating it every 180 CAD period in the same manner as the operation in step 107.

Figure 16:
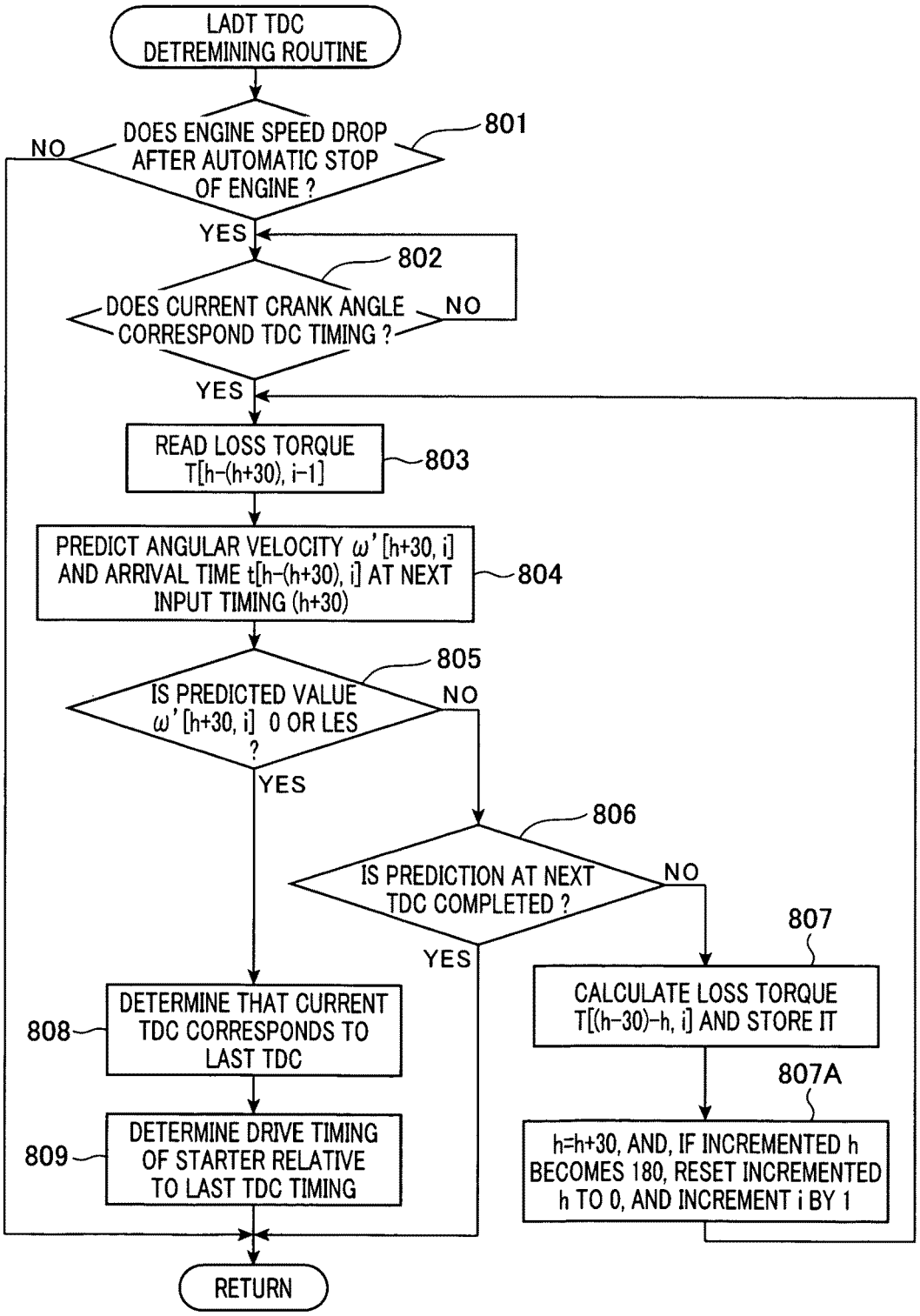
FIG. 16 is a flowchart schematically illustrating a last TDC determining routine to be executed by the ECU according to the fourth embodiment.

The ECU 20 according to the fourth embodiment is also designed to carry out a last TDC determining routine R7 in accordance with the flowchart illustrated in FIG. 16 as part of the engine stop-and-start control routine. The ECU 20 repeatedly runs the last TDC determining routine R7 in a preset cycle during execution of the main engine control routine.

Specifically, when launching the last TDC determining routine R7, the ECU 20 determines whether the engine speed drops after automatic stop of the engine 21 in step 801. Upon determining that the engine speed does not drop after automatic stop of the engine 21 or the engine speed drops with the engine 21 being activated (NO in step 801), the ECU 20 exits the last TDC determining routine R7 because of no need to determine the last TDC in the forward rotation of the crankshaft 22, returning to the main engine control routine.

Otherwise, upon determining that the engine speed drops after automatic stop of the engine 21 (YES in step 801), the ECU 20 determines whether a current crank angle of the crankshaft 22 relative to the reference position corresponds to the TAD timing at which a piston in a cylinder reaches the TAD in step 802. Upon determining that the current crank angle of the crankshaft 22 does not correspond to the TAD timing (NO in step 802), the ECU 20 repeats the determination in step 802.

When the current crank angle of the crankshaft 22 corresponds to the TAD timing within the current 180 CAD period i of the rotation of the crankshaft 22 (YES in step 802), the ECU 20 reads a value T[h−(h+30),i−1] of the loss torque T stored in the register RE in step 803 in the same manner as step 104; this value T[h−(h+30),i−1] of the loss torque T has been calculated to be stored in the register RE in step 807 described later, and corresponds to a crank pulse ω[h+30,i−1] that has been inputted to the ECU 20 150 CAD before the currently inputted crank pulse ω[h,i]. The operation in step 807 corresponds to that in step 704.

For example, when the currently inputted crank pulse corresponds to 0 CAD past the current TDC within the current 180 CAD period (i) of the rotation of the crankshaft 22 (h=0 corresponding to the TDC timing), the ECU 20 reads a value T[0-30,i−1] of the loss torque T; this value T[0-30,i−1] has been calculated to be stored in the register RE, and corresponds to a crank pulse ω[30,i−1] that has been inputted to the ECU 20 150 CA before the currently inputted crank pulse ω[0,i] corresponding to 0 CAD (see FIG. 3).

Note that, when the currently inputted crank pulse corresponds to 0 CAD past the TDC of a cylinder within the first 180 CAD period (i=1) of the rotation of the crankshaft 22 so that no values of the loss torque T have been stored in the register RE, a default value, which has been previously prepared as a value of the loss torque T from 0 CAD to 30 CAD of the crankshaft 22 and stored in the register RE or the storage medium 20*a*, can be used as the value T[0-30,i−1] of the loss torque T.

Next, the ECU 20 calculates, in accordance with the equation [9] or [11] set forth above, a predicted value ω'[h+30,i] of the angular velocity ω based on the value T[h−(h+30),i−1] of the loss torque T read from the register RE at the next input timing of a crank pulse corresponding to (h+30) CAD in step 804 as well as the operation in step 105.

For example, in step 804, the ECU 20 calculates the predicted value ω'[h+30,i] of the angular velocity ω at the corresponding crank angle (h+30) of the crankshaft 22 within the current 180 CAD period i of the rotation of the crankshaft 22.

In step 804, the ECU 20 stores the predicted value ω'[h+30,i] of the angular velocity ω in the register RE or the storage medium 20*a*. Note that, when h+30=180, h+30 is set to 0 and i is incremented by "1".

In step 804, the ECU 20 calculates a predicted value of the arrival time t[h−(h+30),i] at which the crankshaft 22 will arrive at the next input timing of a crank pulse in accordance with the equation [10] set forth above, and stores the predicted value of the arrival time t in the register RE or the storage medium 20*a* in correlation with the predicted value ω'[h+30,i] of the angular velocity ω.

Thereafter, the ECU 20 determines whether the predicted value ω'[h+30,i] of the angular velocity ω at the next input timing of a crank pulse corresponding to (h+30) CAD is equal to or less than zero to thereby determine whether the current TDC timing corresponds to the last TDC in the forward rotation of the crankshaft 22 in step 805 as well as the operation in step 106.

Upon determining that the predicted value ω'[h+30,i] of the angular velocity ω at the next input timing of a crank pulse is more than zero (NO in step 805), the ECU 20 determines that the current TDC timing does not corresponds to the last TDC in the forward rotation of the crankshaft 22, proceeding to step 806.

Then, the ECU 20 determines whether the prediction of a value of the angular velocity ω up to the next TDC is completed in step 806. Upon determining that the current crank angle does not correspond to the next TDC timing within the next 180 CAD period i+1, the ECU 20 determines that the prediction of a value of the angular velocity ω up to the next TDC is not completed (NO in step 806). Then, the ECU 20 proceeds to step 807 and calculates a value T[(h−30)−h,i] of the loss torque T corresponding to the currently inputted crank pulse (h=0 CAD) thereto, and stores the value T[(h−30)−h,i] of the loss torque T in the register RE in step 807 as well as the operation in step 107.

Following the completion of the operation in step 807, the ECU 20 increments the parameter h by 30 in 807A, and returns to step 803 and repeats the operations in steps 803 to 807A until the determination in step 806 is affirmative or the determination in step 805 is affirmative. When the incremented value h becomes 150, the ECU 20 determines that the prediction of a value of the angular velocity ω up to the next TDC, that is, the predicted value ω'[180=0,i+1] is completed (YES in step 806). Then, the ECU 20 terminates the last TDC determining routine R7, and returns to the main engine control routine.

That is, the prediction of the future trajectory of the drop of the engine speed (angular velocity) is carried out every TDC cycle.

During the repeat of the operations in steps 803 to 807A for each TDC cycle, when the currently predicted value ω' of the angular velocity ω is equal to or less than zero, the determination in step 805 is affirmative.

Then, in step 808, the ECU 20 determines that the current TDC timing corresponds to the last TDC in the forward rotation of the crankshaft 22.

Then, in step 809, the ECU 20 determines a timing of the driving of the starter 11 based on the timing of the last TDC in the forward rotation of the crankshaft 22 during the drop of the engine speed. For example, in step 809, the ECU 20 energizes the pinion actuator 14 to shift the pinion 13 to the ring gear 23 at a timing determined relative to the current TDC timing (the last TDC timing) so that the pinion 13 is engaged with the ring gear 23, and drives the motor 12 to rotate the pinion 13, thus cranking the engine 21 to thereby restart it in step 809. After the operation in step 809, the ECU 20 exits the last TDC determining routine R7, and returns to the main engine control routine. For example, the operations in steps 804, 805, 806, and 808 and an equivalent unit of the operations in steps 804, 805, 806, and 808 correspond to a last TDC determiner according to the fourth embodiment of the present invention. For example, the operation in at least step 809 and an equivalent unit of the operation in at least step 809 correspond to a driving timing determiner according to the fourth embodiment of the present invention.

As described above, the engine control system according to the fourth embodiment is configured to predict the future trajectory of the drop of the engine speed with fluctuation after the automatic stop of the engine 21, and determine, le, based on the predicted future trajectory of the drop of the engine 21, the timing corresponding to the last TDC in the forward rotation of the crankshaft 22. Thus, the engine control system can determine the timing corresponding to the last TDC before the engine speed (angular velocity of the crankshaft 22) becomes zero or less, making it possible to determine, with high accuracy, the timing to shift the pinion 13 to the ring gear 23 relative to the last TDC timing.

Note that the last TDC determining routine illustrated in FIG. 16 is designed to predict the future trajectory of the drop of the engine speed every 180 CAD, in other words, every TDC cycle, but the fourth embodiment of the present invention is not limited thereto. Specifically, the last TDC determining routine can be designed to predict the future trajectory of the drop of the engine speed every given cycle, such as 360 CAD.

In addition, the last TDC determining routine illustrated in FIG. 16 is designed to repeat the prediction of a value of the angular velocity ω and a value of the arrival time t each time a crank pulse is inputted from the crank angle sensor 25 to the ECU 20, but the fourth embodiment of the present invention is not limited thereto. Specifically, the last TDC determining routine illustrated in FIG. 16 can be designed to repeat the prediction of a value of the angular velocity ω and a value of the arrival time t every given cycle, such as every 180 CAD and every TDC cycle.

Fifth Embodiment

Figure 17:
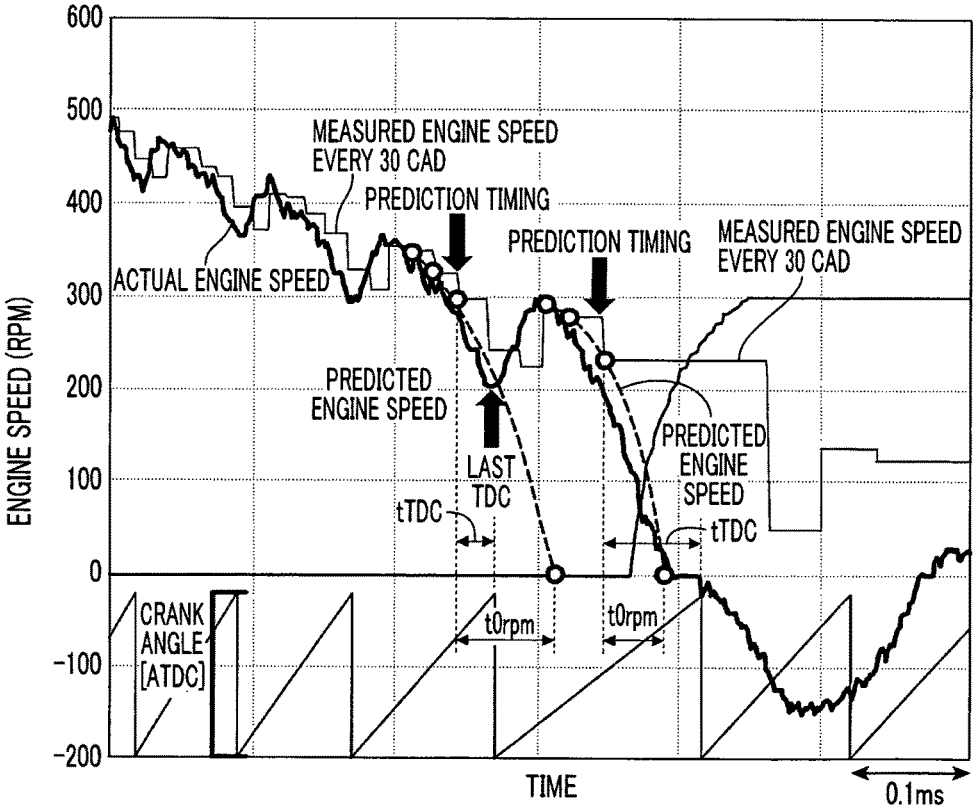
FIG. 17 is a timing chart schematically illustrating a first arrival time at which the crankshaft will arrive at a next TDC timing relative to a current time corresponding to a current TDC, and a second arrival time at which the engine speed will arrive at 0 [RPM] relative to the current time according to the fifth embodiment of the present invention.

An engine control system according to the fifth embodiment of the present invention will be described hereinafter with reference to FIGS. 17 and 18.

The structure and/or functions of the engine control system according to the fifth embodiment are different from the engine control system according to the fourth embodiment by the following points. So, the different points will be mainly described hereinafter.

The engine control system according to the fifth embodiment is configured to:

store a value of the engine speed (angular velocity of the crankshaft 22) each time a crank pulse is inputted thereto from the crank angle sensor 25 as historical data HD of the engine speed (see the phantom line illustrated in FIG. 1);

predict the future trajectory of the engine speed (angular velocity of the crankshaft 22) every given cycle based on the historical data HD of the engine speed up to the current time;

predict, based on the future trajectory of the engine speed, a first arrival time t(TDC) at which the crankshaft 22 will arrive at the next TDC timing relative to the current time;

predict, based on the future trajectory of the engine speed, a second arrival time t(0 RPM) at which the engine speed will arrive at 0 [RPM] relative to the current time; and compare the first arrival time t(TDC) with the second arrival time t(0 RPM) to thereby determine, based on a result of the comparison, whether the current time corresponds to the last TDC timing.

Figure 18:
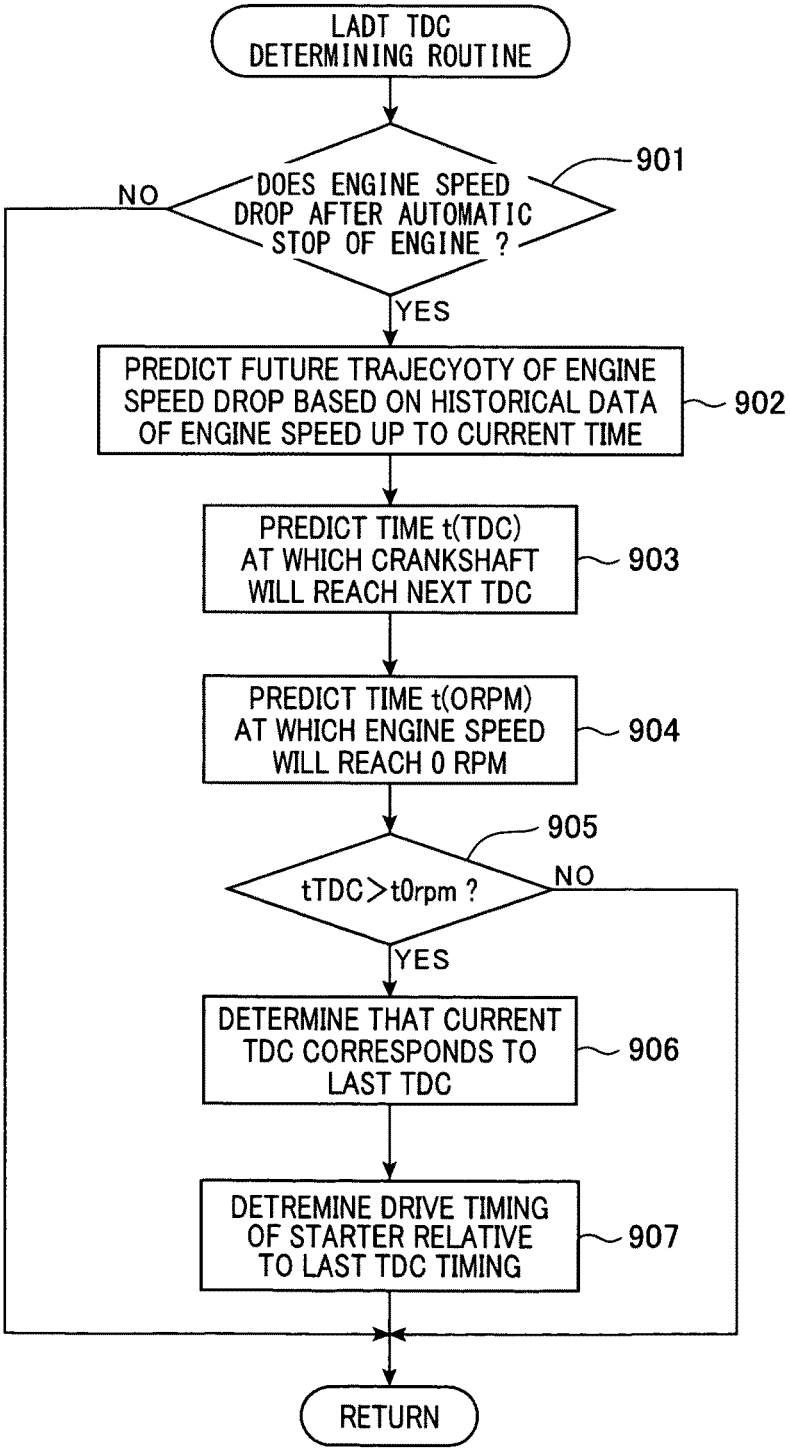
FIG. 18 is a flowchart schematically illustrating a last TDC determining routine to be executed by the ECU according to the fifth embodiment.

The ECU 20 according to the fifth embodiment is also designed to carry out a last TDC determining routine R8 in accordance with the flowchart illustrated in FIG. 18 as part of the engine stop-and-start control routine. The ECU 20 repeatedly runs the last TDC determining routine R8 in a preset cycle, such as 180 CAD cycle, during execution of the main engine control routine.

Specifically, when launching the last TDC determining routine R8, the ECU 20 determines whether the engine speed drops after automatic stop of the engine 21 in step 901. Upon determining that the engine speed does not drop after automatic stop of the engine 21 or the engine speed drops with the engine 21 being activated (NO in step 901), the ECU 20 exits the last TDC determining routine R8 because of no need to determine the last TDC in the forward rotation of the crankshaft 22, returning to the main engine control routine.

Otherwise, upon determining that the engine speed drops after automatic stop of the engine 21 (YES in step 901), the ECU 20 predicts, based on the historical data HD of the history of the change in the engine speed, the future trajectory of the engine speed (angular velocity of the crankshaft 22) up to 0 RPM in step 902.

Next, the ECU 20 calculates, based on the predicted future trajectory of the engine speed, the first arrival time t(TDC) at which the crankshaft 22 will arrive at the next TDC timing relative to the current timing in step 903. Following the operation in step 903, the ECU 20 predicts, based on the future trajectory of the engine speed, the second arrival time t(0 RPM) at which the engine speed will arrive at 0 [RPM] relative to the current time in step 904.

Thereafter, the ECU 20 compares the first arrival time t(TDC) with the second arrival time t(0 RPM) to thereby determine whether the current time corresponds to the last TDC timing in step 905. Specifically, when the first arrival time t(TDC) is smaller than the second arrival time t(0 RPM) (NO in step 905), the ECU 20 determines that the current TDC does not correspond to the last TDC in the forward rotation of the crankshaft 22, then terminating the last TDC determining routine R8.

Otherwise, when the first arrival time t(TDC) is longer than the second arrival time t(0 RPM) (YES in step 905), the ECU 20 determines that the current TDC corresponds to the last TDC in the forward rotation of the crankshaft 22 in step 906.

Then, in step 907, the ECU 20 determines a timing of the driving of the starter 11 based on the timing of the last TDC in the forward rotation of the crankshaft 22 during the drop of the engine speed. For example, in step 907, the ECU 20 energizes the pinion actuator 14 to shift the pinion 13 to the ring gear 23 at a timing determined relative to the current TDC timing (the last TDC timing) so that the pinion 13 is engaged with the ring gear 23, and drives the motor 12 to rotate the pinion 13, thus cranking the engine 21 to thereby restart it in step 907. After the operation in step 907, the ECU 20 exits the last TDC determining routine R8, and returns to the main engine control routine.

As described above, the engine control system according to the fifth embodiment achieves the effects that are identical to those achieved by the fourth embodiment.

In addition, because the last TDC determining routine is repeatedly carried out every given cycle, such as every 180 CAD cycle, it is possible to determine the last TDC timing in the forward rotation of the crankshaft 22 during the engine speed dropping.

Sixth Embodiment

Figure 19:
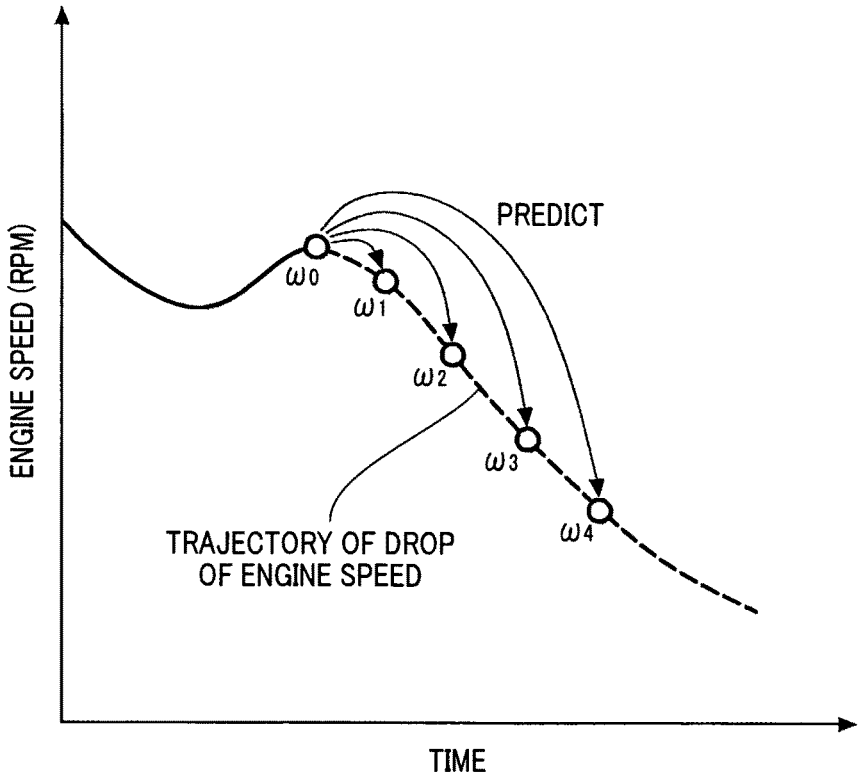
FIG. 19 is a graph schematically illustrating a predicted future trajectory of the drop of an engine speed achieved, as an example, by the engine control system according to the sixth embodiment of the present invention.

An engine control system according to the sixth embodiment of the present invention will be described hereinafter with reference to FIGS. 19 and 20.

The structure and/or functions of the engine control system according to the sixth embodiment are different from the engine control system according to the fourth embodiment by the following points. So, the different points will be mainly described hereinafter.

The engine control system according to the fourth embodiment is configured to predict, at a current prediction timing, a value of the engine speed or the angular velocity of the crankshaft 22 based on: the value of the loss torque T stored in the register RE, the current engine speed (current angular velocity of the crankshaft 22), and the inertia J of the engine 21 (see the operation in step 804 or step 105). In addition, the engine control system according to the fourth embodiment is configured to repeat the prediction of a value of the engine speed and that of a value of the arrival time every given cycle based on: the previous predicted value of the angular velocity, the corresponding value of the loss torque T stored in the register RE, and the inertia J of the engine 21.

In contrast, the engine control system according to the sixth embodiment is configured to predict, at a current prediction timing, a plurality of future values ω'1, ω'2, . . . , ω'n of the angular velocity ω at respective n future prediction timings after the current prediction timing based on the value of the loss torque T stored in the register RE, the current engine speed (current angular velocity of the crankshaft 22), and the inertia J of the engine 21; the n future prediction timings have preset interval therebetween as well as the first embodiment (see the predict future angular velocities and future arrival times in FIG. 3).

The control system according to the sixth embodiment is also configured to predict, based on the plurality of future values ω'1, ω'2, . . . , ω'n of the angular velocity ω, the future trajectory of the drop of the engine speed, and determine whether the current TDC corresponds the last TDC based on the predicted future trajectory of the engine speed.

Figure 20:
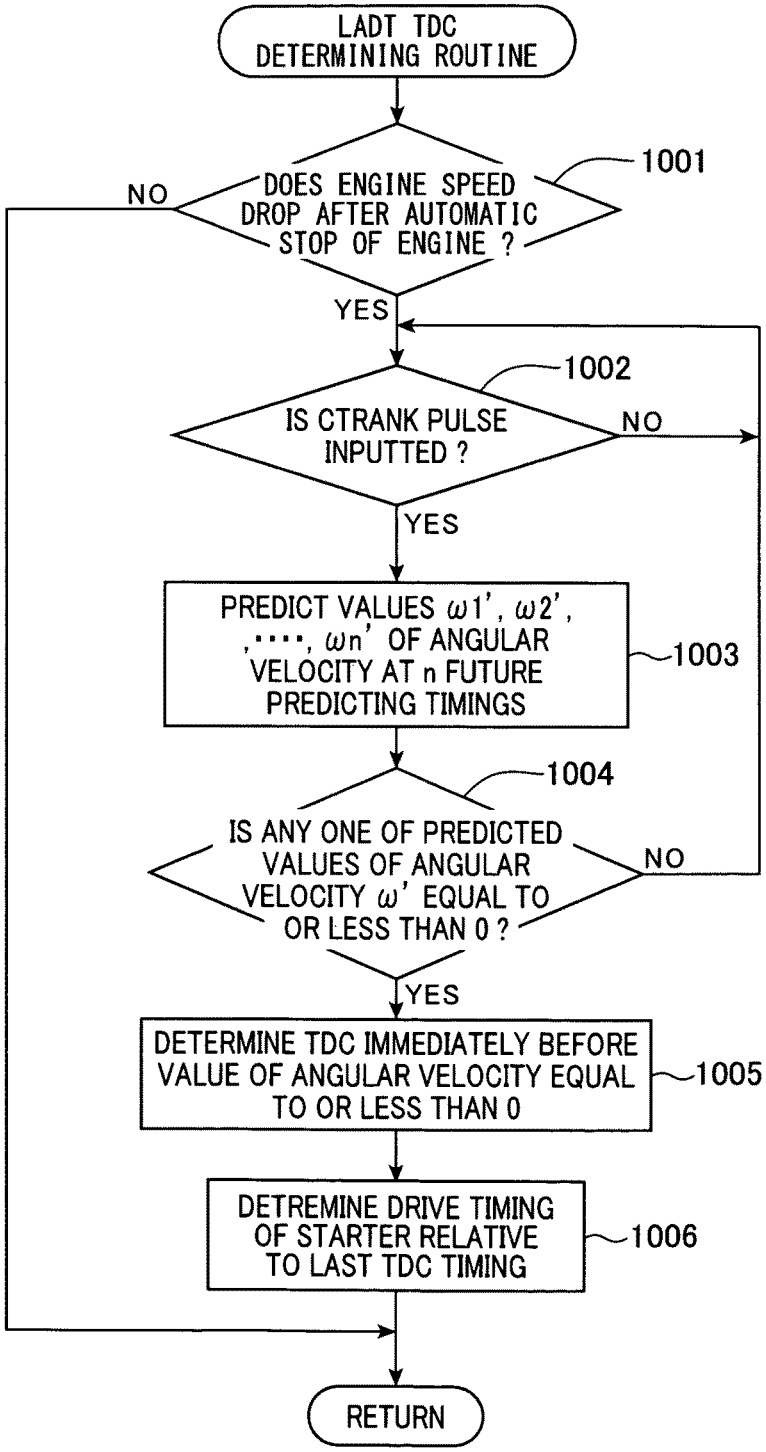
FIG. 20 is a flowchart schematically illustrating a last TUC determining routine to be executed by the ECU according to the sixth embodiment.

The ECU 20 according to the sixth embodiment is designed to carry out a last TDC determining routine R9 in accordance with the flowchart illustrated in FIG. 20 as part of the engine stop-and-start control routine. The ECU 20 repeatedly runs the last TDC determining routine R9 in a preset cycle during execution of the main engine control routine.

Specifically, when launching the last TDC determining routine R9, the ECU 20 determines whether the engine speed drops after automatic stop of the engine 21 in step 1001. Upon determining that the engine speed does not drop after automatic stop of the engine 21 or the engine speed drops with the engine 21 being activated (NO in step 1001), the ECU 20 exits the last TDC determining routine R9 because of no need to determine the last TDC in the forward rotation of the crankshaft 22, returning to the main engine control routine.

Otherwise, upon determining that the engine speed drops after automatic stop of the engine 21 (YES in step 1001), the ECU 20 determines whether a crank pulse is inputted thereto from the crank angle sensor 25 in step 1002. The ECU 20 repeats the determination of step 1002 upon determining that no crank pulses are inputted thereto (NO in step 1002). That is, the ECU 20 proceeds to step 1003 each time a crank pulse is inputted thereto.

In step 1003, the ECU 20 calculates a value (current value) ω0 of the angular velocity ω of the crankshaft 22 corresponding to a currently inputted crank pulse thereto in accordance with the aforementioned equation (1) set forth above. Then, the ECU 20 predicts, at a current prediction timing corresponding to the currently inputted crank pulse, a plurality of future values ω'1, ω'2, . . . , ω'n of the angular velocity ω at respective n future prediction timings after the current prediction timing.

In step 1003, the ECU 20 can predict, at the current prediction timing corresponding to the currently inputted crank pulse, a plurality of future values ω'1, ω'2, . . . , ω'n of the angular velocity ω based on at least one of the corresponding value of the loss torque T stored in the register RE and the inertia J of the engine 21 in the same manner as the predict operations described in the fourth embodiment. In step 103, the ECU 20 can predict, at the current prediction timing corresponding to the currently inputted crank pulse, a plurality of future values ω'1, ω'2, . . . , ω'n of the angular velocity ω based on the historical data HD of the engine speed up to the current prediction timing in the same manner as the predict operations described in the fifth embodiment. The n future prediction timings have preset intervals of, for example, 30 CADs of the rotation of the crankshaft 22, therebetween.

Following the operation in step 1003, the ECU 20 determines whether any one of the plurality of future values ω'1, ω'2, . . . , ω'n of the angular velocity ω is equal to or less than 0 [RPM] in step 1004. Upon determining that none of the plurality of future values ω'1, ω'2, . . . , ω'n of the angular velocity ω is greater than 0 [RPM] (NO in step 1004), the ECU 20 returns to step 1002, and repeats the operations steps 1002 to 1004 each time a crank pulse is inputted thereto. That is, each time a crank pulse is inputted to the ECU 20, the ECU 20 predicts a plurality of future values ω'1, ω'2, . . . , ω'n of the angular velocity ω after the crank-pulse input timing and determines whether any one of the plurality of future values ω'1, ω'2, . . . , ω'n of the angular velocity ω is equal to or less than 0 [RPM].

During the repeat of the operations in steps 1002 to 1004, when any one of the plurality of future values ω'1, ω'2, . . . , ω'n of the angular velocity ω is equal to or less than 0 [RPM] (YES in step 1004), the ECU 20 determines that the TDC immediately before any one of the plurality of future values ω'1, ω'2, . . . , ω'n of the angular velocity ω, which is equal to or less than zero, corresponds to the last TDC timing in the forward rotation of the crankshaft 22 in step 1005. Then, the ECU 20 determines, in step 1006, a timing of the driving of the starter 11 based on the timing of the last TDC in the forward rotation of the crankshaft 22 during the drop of the engine speed. For example, in step 1006, the ECU 20 energizes the pinion actuator 14 to shift the pinion 13 to the ring gear 23 at a timing determined relative to the current TDC timing (the last TDC timing) so that the pinion 13 is engaged with the ring gear 23, and drives the motor 12 to rotate the pinion 13, thus cranking the engine 21 to thereby restart it in step 1006. After the operation in step 1006, the ECU 20 exits the last TDC determining routine R9, and returns to the main engine control routine.

As described above, the engine control system according to the sixth embodiment achieves the effects that are identical to those achieved by the fourth embodiment.

The engine control system according to the sixth embodiment is configured to predict the future trajectory of the drop of the engine speed each time a crank pulse is inputted thereto from the crank angle sensor 25, but the sixth embodiment of the present invention is not limited thereto.

Specifically, the engine control system according to the sixth embodiment can be configured to predict the future trajectory of the drop of the engine speed each time a preset number of crank pulses are inputted thereto from the crank angle sensor 25, or every TDC cycle.

The engine control system according to each of the fourth and sixth embodiments is configured to determine whether the current prediction timing corresponds to the last TDC by determining whether the predicted value of the angular velocity ω is equal to or less than zero [RPM], but each of the fourth and sixth embodiments is not limited to the configuration.

Specifically, the engine control system according to each of the fourth and sixth embodiments can be configured to determine whether the current prediction timing corresponds to the last TDC by determining whether the predicted value of the angular velocity ω is equal to or less than a preset positive value [RPM] in consideration of a margin of error contained in the predicted value of the angular velocity ω.

In each of the first to sixth embodiments, the engine control system is designed such that the crank angle sensor 25 measures the angular velocity of the rotation of the crankshaft 22 of the engine 21, but the present invention is not limited thereto.

Specifically, a sensor designed to directly measure the rotational speed of a pulley coupled to the crankshaft 22, which will be referred to as pulley rotation sensor, or a sensor designed to directly measure the rotational speed of the ring gear 23 can be used as means for measuring the angular velocity of the rotation of the crankshaft 22 of the engine 21 in place of or in addition to the crank angle sensor 25. In these sensors, the sensor, which will be referred to as ring-gear rotation sensor, designed to directly measure the rotational speed of the ring gear 23 can be preferably used as means for measuring the rotational speed of the engine 21. This is because the ring-gear rotation sensor is designed to pick up a change in a previously formed magnetic field according to the rotation of teeth formed on the outer circumference of the ring gear 23; the number of the teeth formed on the outer circumference of the ring gear 23 is greater than the number of the teeth of the reluctor disc of the crank angle sensor and that of teeth formed on the outer circumference of the pulley.

The aspect of each of the first to sixth embodiment of the present invention is applied to the corresponding engine control system equipped with the starter 11 designed to individually drive the pinion actuator 14 and the motor 12 for rotating the pinion 13, but each of the first to sixth embodiment of the present invention is not limited to the application.

Specifically, an alternative aspect of each of the first to sixth embodiment of the present invention is applied to an engine control system equipped with a starter designed to simultaneously drive the pinion actuator 14 and the motor 12 or a starter designed to drive one of the pinion actuator 14 and the motor 12, and after the lapse of a preset delay time, drive the other thereof. For example, when such a starter is used for the engine control system according to one of the first to third embodiments, the engine control system can be designed to determine, based on the future trajectory of the engine speed, whether the engine speed is within the very low-speed range of, for example, 300 RPM or less, more specifically, 50 to 100 RPM, and, when it is determined that the engine speed is within the very low-speed range, controls the pinion actuator 14 to shift the pinion 13 to the ring gear 23.

In each of the first to sixth embodiments, the crank-angle measurement resolution can be set to a desired angle except for 30 CAD.

Apparently, the routines R1 to R9 are stored in the storage medium 20*a* of the ECU 20, but, in the ECU 20 of the engine control system 1 according to the first embodiment, at least the routines R1 and R2 are required to be stored in the ECU 20. That is, in the storage medium 20*a* of the ECU 20 of the engine control system according to each of the first to sixth embodiments, a corresponding at least one of the routines R1 to R9 is required to be stored.

While illustrative embodiments of the invention have been described herein, the present invention is not limited to the various embodiments described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be constructed as non-exclusive.

What is claimed is:

1. A system for driving a starter with a pinion so that the starter rotates a ring gear coupled to a crankshaft of an internal combustion engine to crank the internal combustion engine during a drop of a rotational speed of the crankshaft by automatic-stop control of the internal combustion engine, the system comprising:

a register;

a predictor that predicts a future trajectory of the rotational speed of the crankshaft dropping with fluctuations based on information associated with the rotational speed of the crankshaft dropping with fluctuations;

a determiner that determines a timing of the driving of the starter based on the future trajectory of the rotational speed of the crankshaft dropping with fluctuations; and a controller for controlling the starter based on the determined timing of the driving of the starter;

wherein:

the starter comprises the pinion, a pinion actuator for shifting the pinion to the ring gear, and a motor for rotating the pinion independently of the pinion actuator, the information associated with the rotational speed of the crankshaft dropping with fluctuations includes a previously determined inertia of the internal combustion engine, the predictor is configured to:

calculate a value of a loss torque of the crankshaft at each preset crank-angular cycle, the crank-angular cycle being shorter than a top-dead-center (TDC) period of the internal combustion engine;

store, in the register, at least a set of the values of the loss torque for each TDC period;

read, at each crank-angular cycle in each TDC period, a predetermined one of the values of the loss torque of the internal combustion engine calculated in at least one previous TDC period from the register; and calculate, at each crank-angular cycle in each TDC period, what a value of the rotational speed of the crankshaft will be based on the previously determined inertia of the internal combustion engine and the predetermined one of the values of the loss torque of the internal combustion engine read from the register, thus predicting the future trajectory of the rotational speed of the crankshaft, and the determiner is configured to determine, as the timing of the driving of the starter, a first timing to drive the pinion actuator to shift the pinion to the ring gear and a second timing to drive the motor to rotate the pinion based on the future trajectory of the rotational speed of the crankshaft dropping with fluctuations, each of the first timing to drive the pinion actuator to shift the pinion to the ring gear and the second timing to drive the motor to rotate the pinion being determined as a corresponding elapsed time since the reference point of time based on the future trajectory of the drop of the rotational speed of the crankshaft.

2. The system according to claim 1, wherein the predictor is configured to interpolate linearly or curvedly between the predicted values of the rotational speed of the crankshaft to thereby predict the future trajectory of the rotational speed of the crankshaft dropping with fluctuations.

3. The system according to claim 1, wherein the predictor is configured to:

sample a current value of the rotational speed of the crankshaft each time the crankshaft rotates at a preset crank angle as the preset cycle to thereby predict the value of the rotational speed of the crankshaft will be at a next sampling timing; and accelerate a time of the predicted value of the rotational speed of the crankshaft by a delay due to the sampling.

4. The system according to claim 1, wherein the determiner further comprises:

a first restart unit that executes, in a motor pre-drive mode, a first restart task to drive the motor to rotate the pinion before shifting of the pinion to the ring gear when an engine restart condition is met during the drop of the rotational speed of the crankshaft, a first engine-speed range from a lower limit value to an upper limit value within which the restart of the internal combustion engine in the motor pre-drive mode is allowed being previously defined on the future trajectory of the drop of the rotational speed of the crankshaft; and a first setting unit that sets a motor pre-drive disabling time for disabling the restart of the internal combustion engine in the motor pre-drive mode such that the motor pre-drive disabling time is by a first preset time prior to a first elapsed time of the lower limit value of the first engine-speed range since the reference point of time, the first preset time being taken, at the first elapsed time of the lower limit value of the first engine-speed range, from a start of the shift of the pinion to the ring gear to an abutment of the pinion onto the ring gear.

5. The system according to claim 1, wherein the determiner further comprises:

a second restart unit that executes, in a motor post-drive mode, a second restart task to drive the pinion actuator to shift the pinion to the ring gear so that the pinion is abutted onto the ring gear and thereafter to drive the motor to rotate the pinion when an engine restart condition is met during the drop of the rotational speed of the crankshaft, a second engine-speed range from a lower limit value to an upper limit value within which the restart of the internal combustion engine in the motor post-drive mode is allowed being previously defined on the future trajectory of the drop of the rotational speed of the crankshaft; and a second setting unit that sets a motor post-drive enabling time for enabling the restart of the internal combustion engine in the motor post-drive mode such that the motor post-drive enabling time is by a second preset time prior to a second elapsed time of the upper limit value of the second engine-speed range since the reference point of time, the second preset time being taken, at the second elapsed time of the upper limit value of the second engine-speed range since the reference point of time, from a start of the shift of the pinion to the ring gear to an abutment of the pinion onto the ring gear.

6. The system according to claim 4, wherein the determiner further comprises:

an enabling unit that enables execution of pinion-preset control at a preset value of the rotational speed of the crankshaft before an engine restart condition is not met during the drop of the rotational speed of the crankshaft, the pinion-preset control being to drive the pinion actuator to shift the pinion to the ring gear so that the pinion is abutted onto the ring gear to thereby ready for restart of the internal combustion engine; and a third setting unit configured to set a start time of the execution of the pinion-preset control such that the start time of the execution of the pinion-preset control is by a third preset time prior to a third elapsed time of the preset value of the rotational speed of the crankshaft since the reference point of time, the third preset time being taken, at the third elapsed time of the preset value of the rotational speed of the crankshaft since the reference point of time, from a start of the shift of the pinion to the ring gear to an abutment of the pinion onto the ring gear.

7. The system according to claim 4, wherein the determiner further comprises:

a disabling unit that disables execution of pinion-preset control before an engine restart condition is not met during the drop of the rotational speed of the crankshaft, the pinion-preset control being to drive the pinion actuator to shift the pinion to the ring gear so that the pinion is abutted onto the ring gear to thereby ready for restart of the internal combustion engine;

a second restart unit that executes, in a motor post-drive mode, to drive the motor to rotate the pinion after an abutment of the pinion onto the ring gear when the engine restart condition is met during the drop of the rotational speed of the crankshaft; and a fourth setting unit configured to set a start time to increase a delay time such that the start time to increase the delay time is by a fourth preset time prior to a fourth elapsed time since the reference point of time, the delay time being required for the pinion to be completely engaged since the start of the shift of the pinion to the ring gear, the fourth preset time being taken, at the fourth elapsed time since the reference point of time, from a start of the shift of the pinion to the ring gear to an abutment of the pinion onto the ring gear, the rotational speed of the crankshaft being a preset value or less at the fourth elapsed time since the reference point of time.

8. The system according to claim 4, wherein the determiner is configured to:

predict a future trajectory of an increase of a rotational speed of the pinion after driving the motor to rotate the pinion in the motor pre-drive mode;

predict, based on the future trajectory of the drop of the rotational speed of the crankshaft and the future trajectory of the increase of the rotational speed of the pinion, a fifth elapsed time since the reference point of time, a difference between a value of the future trajectory of the drop of the rotational speed of the crankshaft at the fifth elapsed time and a value of the future trajectory of the increase of the rotational speed of the pinion at the fifth elapsed time being within a preset threshold; and accelerate the fifth elapsed time since the reference point of time by a fifth preset time, the fifth preset time being taken, at the fifth elapsed time since the reference point of time, from a start of the shift of the pinion to the ring gear to an abutment of the pinion onto the ring gear.

9. The system according to claim 1, further comprising:

an engagement disable request generating unit configured to generate an engagement disable request for disabling engagement of the pinion with the ring gear during prediction of the future trajectory of the drop of the rotational speed of the crankshaft by the predictor when it is determined that a required level of an accuracy of the prediction is not ensured, wherein the determiner is configured to disable restart of the internal combustion engine during the drop of the rotational speed of the crankshaft when the engagement disable request is generated by the engagement disable request generating unit.

10. The system according to claim 4, further comprising:

an engagement disable request generating unit configured to generate an engagement disable request for disabling engagement of the pinion with the ring gear during prediction of the future trajectory of the drop of the rotational speed of the crankshaft by the predictor when it is determined that a required level of an accuracy of the prediction is not ensured, wherein, during execution of the first restart task in the motor pre-drive mode by the first restart unit, the determiner is configured to:

cancel the shift of the pinion to the ring gear when the engagement disable request is generated before the start of the shift of the pinion to the ring gear; and ignore, when the engagement disable request is generated after the start of the shift of the pinion to the ring gear, the engagement disable request to continue the first restart task in the motor pre-drive mode.

11. A system for driving a starter with a pinion so that the starter rotates a ring gear coupled to a crankshaft of an internal combustion engine to crank the internal combustion engine during a drop of a rotational speed of the crankshaft by automatic-stop control of the internal combustion engine, the system comprising:

an electronic control unit (ECU), including a computer processor and a register, the electronic control unit being configured to:

predict a future trajectory of the rotational speed of the crankshaft dropping with fluctuations based on information associated with the rotational speed of the crankshaft dropping with fluctuations;

determine a timing of the driving of the starter based on the future trajectory of the rotational speed of the crankshaft dropping with fluctuations; and control the starter based on the determined timing of the driving of the starter;

wherein:

the starter comprises the pinion, a pinion actuator for shifting the pinion to the ring gear, and a motor for rotating the pinion independently of the pinion actuator, the information associated with the rotational speed of the crankshaft dropping with fluctuations includes a previously determined inertia of the internal combustion engine, and the electronic control unit is configured to:

calculate a value of a loss torque of the crankshaft at each preset crank-angular cycle, the crank-angular cycle being shorter than a top-dead-center (TDC) period of the internal combustion engine;

store, in the register, at least a set of the values of the loss torque for each TDC period;

read, at each crank-angular cycle in each TDC period, a predetermined one of the values of the loss torque of the internal combustion engine calculated in at least one previous TDC period from the register; and calculate, at each crank-angular cycle in each TDC period, what a value of the rotational speed of the crankshaft will be based on the previously determined inertia of the internal combustion engine and the predetermined one of the values of the loss torque of the internal combustion engine read from the register, thus predicting the future trajectory of the rotational speed of the crankshaft, and determine, as the timing of the driving of the starter, a first timing to drive the pinion actuator to shift the pinion to the ring gear and a second timing to drive the motor to rotate the pinion based on the future trajectory of the rotational speed of the crankshaft dropping with fluctuations, each of the first timing to drive the pinion actuator to shift the pinion to the ring gear and the second timing to drive the motor to rotate the pinion being determined as a corresponding elapsed time since the reference point of time based on the future trajectory of the drop of the rotational speed of the crankshaft.

12. The system according to claim 1, wherein the predictor is configured to, at each current crank-angular cycle in each TDC period, what a value of the rotational speed of the crankshaft will be again based on the previously determined inertia of the internal combustion engine and the predetermined one of the values of the loss torque of the internal combustion engine read from the register although a part of the future trajectory has been already predicted by the predictor.

* * * * *